US010854959B2

(12) United States Patent
Jang et al.

(10) Patent No.: US 10,854,959 B2
(45) Date of Patent: Dec. 1, 2020

(54) CLOAKING ARRANGEMENT FOR LOW PROFILE TELECOMMUNICATIONS ANTENNA

(71) Applicant: John Mezzalingua Associates, LLC, Liverpool, NY (US)

(72) Inventors: Taehee Jang, Fayetteville, NY (US); Niranjan Sundararajan, Liverpool, NY (US); Lance D. Bamford, Pittsford, NY (US); Evan C. Wayton, Tully, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 16/486,283

(22) PCT Filed: Mar. 2, 2018

(86) PCT No.: PCT/US2018/020618
§ 371 (c)(1),
(2) Date: Aug. 15, 2019

(87) PCT Pub. No.: WO2018/164947
PCT Pub. Date: Sep. 13, 2018

(65) Prior Publication Data

US 2020/0052388 A1 Feb. 13, 2020

Related U.S. Application Data

(60) Provisional application No. 62/467,569, filed on Mar. 6, 2017.

(51) Int. Cl.
*H01Q 1/24* (2006.01)
*H01Q 1/42* (2006.01)
(Continued)

(52) U.S. Cl.
CPC ..... *H01Q 1/246* (2013.01); *H01Q 1/422* (2013.01); *H01Q 1/521* (2013.01); *H01Q 9/285* (2013.01); *H01Q 21/062* (2013.01); *H01Q 21/28* (2013.01)

(58) Field of Classification Search
CPC combination set(s) only.
See application file for complete search history.

(56) References Cited

U.S. PATENT DOCUMENTS 5,008,681 A 4/1991 Cavallaro et al.
6,034,649 A * 3/2000 Wilson ..... H01Q 1/246 343/795

(Continued)

FOREIGN PATENT DOCUMENTS

WO 2016/081036 A1 5/2016

OTHER PUBLICATIONS

International Searching Authority, ISR/WO, International Application No. PCT/US18/20618, dated Apr. 19, 2018 (11 pages).

(Continued)

*Primary Examiner* — Ganiyu A Hanidu
(74) *Attorney, Agent, or Firm* — Barclay Damon LLP

(57) ABSTRACT

A telecommunications antenna comprising a plurality of unit cells each including at least one radiator which transmits RF energy within a bandwidth range which is a multiple of another radiator. The radiators are proximal to each other such that a resonant condition may be induced into the at least one radiator upon activation of the other radiator. At least one of the radiators is segmented into capacitively-connected radiator elements to suppress a resonance response therein upon activation of the other of the radiator.

11 Claims, 26 Drawing Sheets

(51) Int. Cl.

| | |
|---|---|
| ***H01Q 1/52*** | (2006.01) |
| ***H01Q 9/28*** | (2006.01) |
| ***H01Q 21/06*** | (2006.01) |
| ***H01Q 21/28*** | (2006.01) |

(56) References Cited

U.S. PATENT DOCUMENTS

| | | | | |
|---|---|---|---|---|
| 7,132,995 | B2 * | 11/2006 | Gottl | H01Q 1/246 343/797 |
| 2012/0248887 | A1 * | 10/2012 | Kesler | H02J 50/90 307/104 |
| 2015/0214617 | A1 * | 7/2015 | Shang | H01Q 21/26 343/722 |
| 2015/0249288 | A1 | 9/2015 | Dockon | |
| 2016/0301144 | A1 * | 10/2016 | Xiao | H01Q 1/246 |
| 2017/0110786 | A1 * | 4/2017 | Liu | G06F 1/1641 |
| 2017/0310009 | A1 * | 10/2017 | Isik | H01Q 21/062 |

OTHER PUBLICATIONS

International Preliminary Report on Patentability, International Application No. PCT/US2018/020618, dated Sep. 10, 2019 (9 pages).
Chinese First Notice of Amendment, Application No. 2017900001109.4 (PCT/US17/044515), dated Jul. 10, 2019 (2 pages).

* cited by examiner

CLOAKING ARRANGEMENT FOR LOW PROFILE TELECOMMUNICATIONS ANTENNA

CROSS-REFERENCE TO RELATED APPLICATIONS

This application claims the benefit of the filing date and priority of U.S. Provisional Patent Application No. 62/467,569, entitled "Cloaking Arrangement for Telecommunications Antenna," filed on Mar. 6, 2017. Furthermore, this application is related to U.S. Non-Provisional Utility patent application Ser. No. 15/663,266, entitled "Low Profile Telecommunications Antenna" filed on Jul. 28, 2017. The complete specification of each application is hereby incorporated by reference in its entirety.

BACKGROUND

The present invention relates to antennas for use in a wireless communications system and, more particularly, to a high performance/capacity, low profile telecommunications antenna.

Typical cellular systems divide geographical areas into a plurality of adjoining cells, each cell including a wireless cell site or "base station." The cell sites operate within a limited radio frequency band and, accordingly, the carrier frequencies employed must be used efficiently to ensure sufficient user capacity in the system.

There are many ways to increase the call carrying capacity, the quality and reliability of a telecommunications antenna. One way includes the creation of additional cell sites across a smaller geographic area. Partitioning the geographic area into smaller regions, however, involves purchasing additional equipment and real estate for each cell site.

To improve the efficacy and reliability of wireless systems, service providers often rely on "antenna diversity". Diversity improves the ability of an antenna to see an intended signal around natural geographic structures and features of the landscape, including man-made structures such as high-rise buildings. A diversity antenna array helps to increase coverage as well as to overcome fading. Antenna polarization is another important consideration when choosing and installing an antenna. For example, polarization diversity combines pairs of antennas with orthogonal polarizations to improve base station uplink gain. Given the random orientation of a transmitting antenna, when one diversity-receiving antenna fades due to the receipt of a weak signal, the probability is high that the other diversity-receiving antenna will receive a strong signal. Most communications systems use a variety of polarization diversity including vertical, slant or circular polarization.

"Beam shaping" is another method to optimize call carrying capacity by providing the most available carrier frequencies within demanding geographic sectors. Oftentimes user demographics change such that the base transceiver stations have insufficient capacity to deal with current demand within a localized area. For example, a new housing development within a cell may increase demand within that specific area. Beam shaping can address this problem by distributing the traffic among the transceivers to increase coverage in the demanding geographic sector.

All of the methods above can translate into savings for the telecommunications service provider. Notwithstanding the elegant solutions that some of these methods provide, the cost of cellular service continues to rise simply due to the limited space available on elevated structures, i.e., cell towers and high rise buildings. As the user demand has risen, the cost associated with antenna mounting has also increased, largely as a function of the "base loading" on the cell tower, i.e., the moment loads generated at the base of the tower. Accordingly, cell tower owners/operators typically lease space as a function of the "sail area" of the telecommunications antenna. It will, therefore, be appreciated that it is fiscally advantageous for service providers to operate telecommunications antennas which have a small, faired, aerodynamic profile to lease space at the lowest possible cost.

As a consequence of the aerodynamic drag/sail area requirements of the antenna, it will be appreciated that the various internal components thereof, i.e., the high and low-band radiators, will necessarily be densely packed within the confined area(s) of the antenna housing. The close proximity of the internally-mounted, high and low-band radiators can effect signal disruption and interference. Such interference is exacerbated as a consequence of the bandwidth being transmitted by each of the high and low-band radiators.

For example, a first radiator can produce a resonant response in a second, adjacent radiator, if the transmitted bandwidth associated with the first radiator is a multiple of the bandwidth transmitted by the second radiator. As the bandwidth differential approaches one-quarter (¼) to one-half (½) of the transmitted wavelength (A), a first radiator which is transmits in this range may be additionally excited by the energy transmitted by the second radiator. This combination causes portions of the transmitted signal to be amplified while yet other portions to be cancelled. Consequently, the Signal to Noise Interference Ratio, (i.e., SINR,) grows along with the level of white noise or "interference."

Accordingly, there is a constant need in the art to improve the capacity, i.e., the number of mobile devices serviced, reliability and performance of the cell phones operated by a particular telecommunications system provider.

The foregoing background describes some, but not necessarily all, of the problems, disadvantages and shortcomings related to telecommunications antennas.

SUMMARY

In a first embodiment, an antenna is provided comprising a plurality of alternating first and second unit cells, each comprising low and high band radiators/The first unit cells comprises a first plurality of low-band radiators and a first plurality of high-band radiators, which collectively produce a first configuration. The second unit cells include a second plurality of low-band radiators and a second plurality of high-band radiators, which collectively produce a second configuration. The first and second configurations are arranged such that alternating low-band radiators have a relative azimuth spacing corresponding to an array factor in an azimuth plane which produces a fast roll-off radiation pattern.

In a second embodiment, a telecommunications antenna is provided comprising a plurality of unit cells each including at least one radiator which transmits RF energy within a bandwidth which is a multiple of another radiator within the same unit cell. Inasmuch as the radiators are in close proximity within each unit cell, a resonant condition is induced into the at least one radiator upon activation of the other radiator. In one embodiment, at least one of the radiators is segmented to filter unwanted resonances therein upon activation of the other of the radiator.

Additional features and advantages of the present disclosure are described in, and will be apparent from, the following Brief Description of the Drawings and Detailed Description.

DETAILED DESCRIPTION

The disclosure is directed to a high aspect ratio, telecommunications antenna having a high capacity output while remaining within a relatively compact, small/narrow design envelope. While the antenna may be viewed as a sector antenna, i.e., connected to a plurality of antennas to provide three-hundred and sixty (3600) degrees of coverage, it will be appreciated that the antenna may be employed individually to radiate RF energy to a desired coverage area. Furthermore, while the elongate axis of the antenna will generally be mounted vertically, i.e., parallel to a vertical Y-axis, it should be appreciated that the antenna may be mounted such that the elongate axis is parallel to the horizon.

Figure 1:
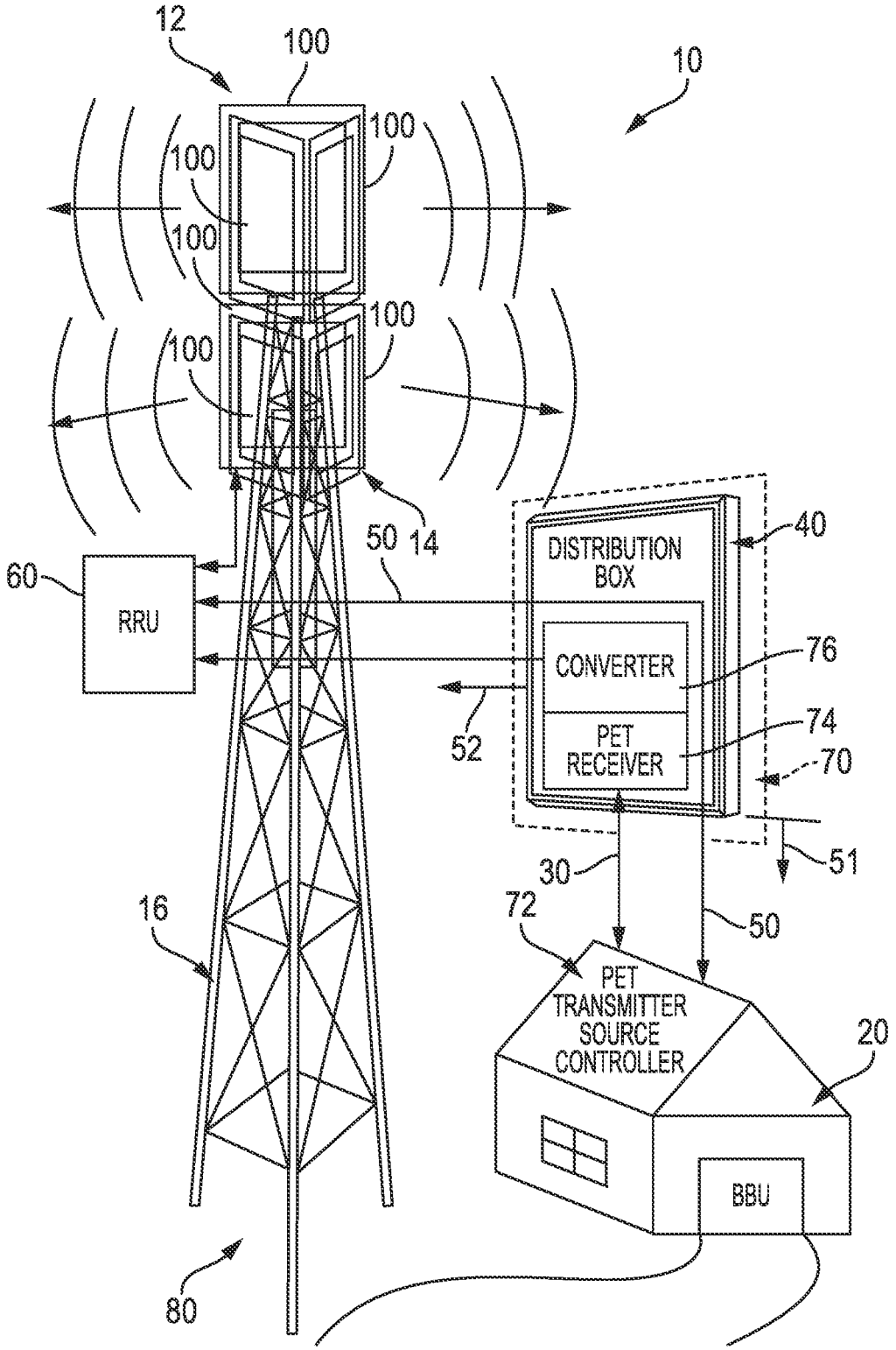
FIG. 1 depicts a macro antenna system including a base station, an elevated tower, one or more telecommunications antennas mounted to the tower, and a system of delivering power/data to the telecommunications antennas.

In FIG. 1, the high aspect ratio (AR), high performance (HP), low profile (LP) telecommunication antenna is shown and described in the context of a Macro Antenna or MAS Telecommunication System 10 which transmits/receives RF signals to/from a Base Transceiver Station (BTS) 20. The described embodiment depicts two (2) multi-sector antenna systems 12 and 14, each mounted to an elevated structure, i.e., a tower 16, one mounted atop the other. Each of the multi-sector antennas 12, 14 comprises three (3) sector antennas 100 in accordance with the teachings of the invention described herein.

In this embodiment, a power component of the power/data distribution system is: (i) conveyed over a high gauge, low weight copper cable 30, (ii) maintained at a first power level above a threshold on a first side (identified by arrow S1) of the connecting interface/distribution box 40, and (iii) lowered to a second power level below the threshold on a second side (denoted by arrow S2) of the connecting interface. A data component of the power/data distribution system may be: (i) carried over a conventional, light-weight, fiber optic cable 50, and (ii) passed through the connecting interface/distribution box 40. With respect to the latter, the fiber optic cable 50 may be passed over, or around, the interface/distribution box 40 without discontinuing, breaking or severing the fiber optic cable 50. Alternatively, the fiber optic cable 50 may be terminated in the distribution box 40 and converted, by a fiber switch to convert optic data into data suitable for being carried over a coaxial cable.

It should be appreciated that various technologies may be brought to bare on the power/data distribution system. For example, Wave Division Multiplexing (WDM) may be used to carry multiple frequencies, i.e., the frequencies used by various service providers/carriers, along a common fiber optic cable. This technology may also be used to carry the signal across greater distances. Additionally, to provide greater flexibility or adaptability, a splitter (not shown) may be employed to split the fiber optic signal, i.e., the data being conveyed to the distribution box 40, such that it may be conveyed/connected to one of the many Remote Radio Units 60 which converts the data into RF energy for being radiated and received by each of the telecommunications antennas 100.

As mentioned in the background, each of the telecommunications antennas 100 have a characteristic aerodynamic profile drag which produces a moment vector at the base 80 of the tower 16. The larger the surface, or sail area, of the telecommunication antenna 100, the larger the magnitude of the tower loading. As a consequence, owner/operators of base stations calculate lease rates based on the profile drag area produced by the antenna 100 rather than on other measurable criteria such as the weight, capacity, or voltage consumed by the telecommunication antennas 100. Therefore, it is fiscally advantageous to minimize the overall aerodynamic drag produced by the telecommunications antenna 100.

Figure 2:
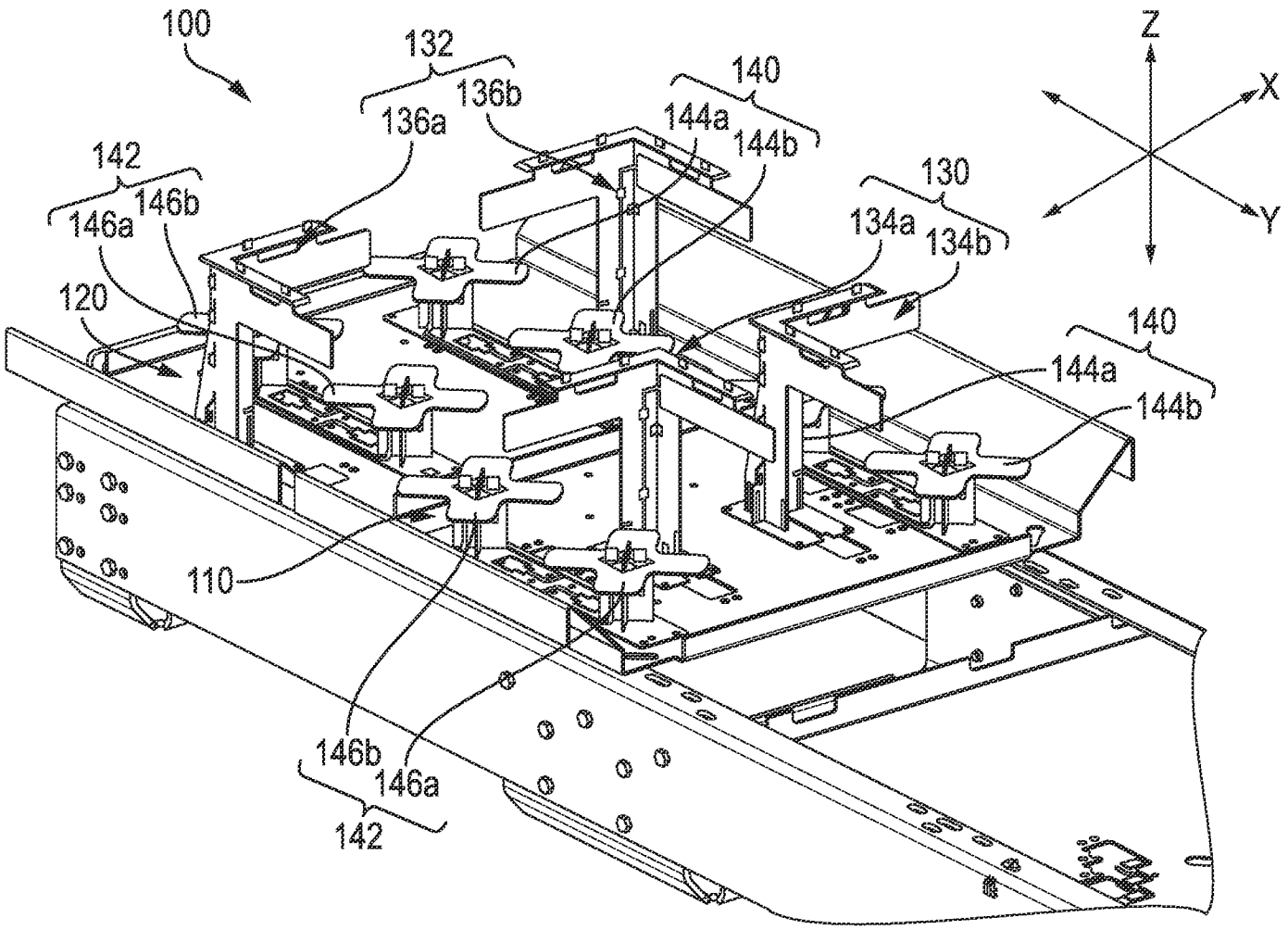
FIG. 2 is a partially broken-away, perspective view of a high aspect ratio, high performance, low profile (HPLP) telecommunications antenna according to one embodiment of the disclosure.
Figure 3:
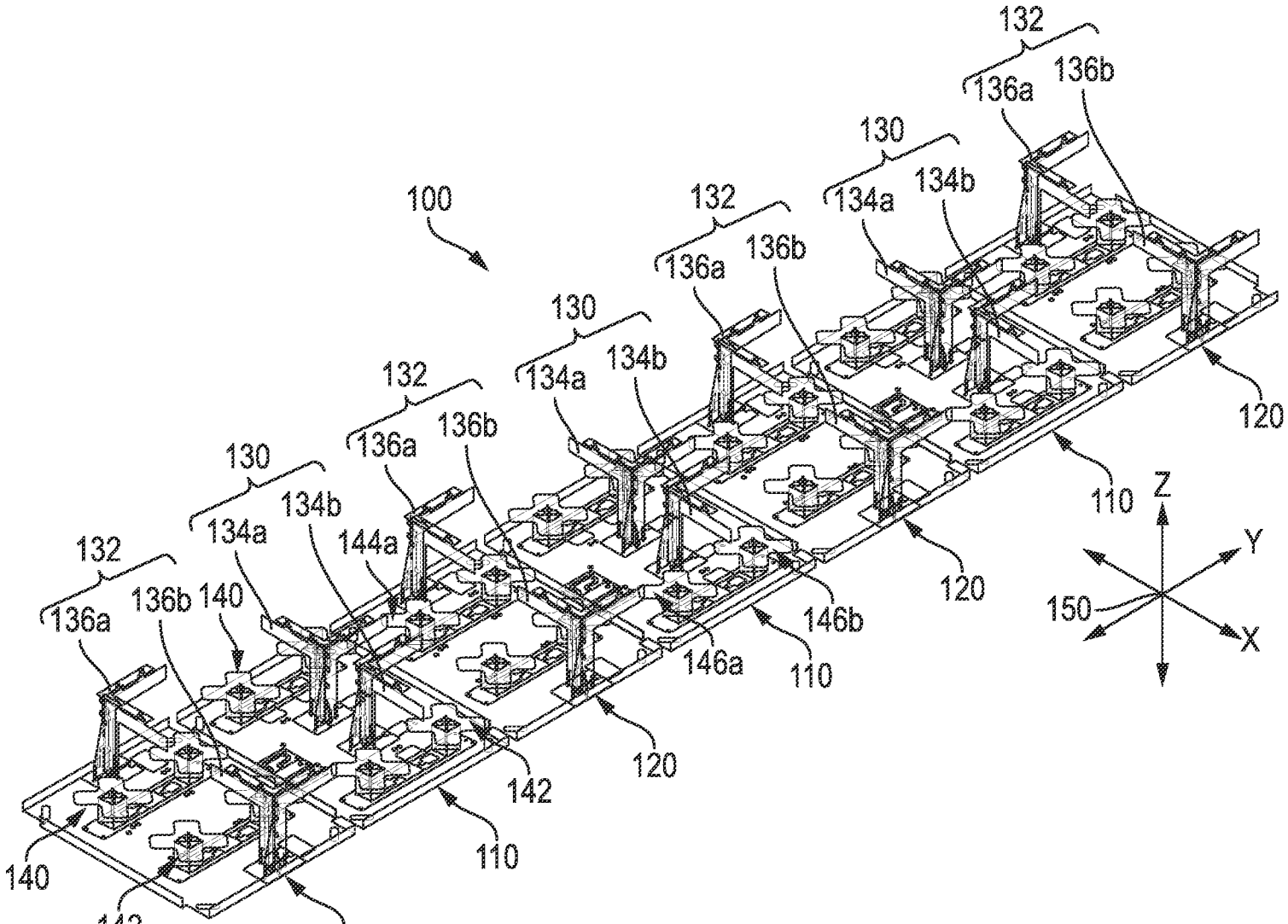
FIG. 3 is a perspective view of the HPLP telecommunications antenna according to the embodiment of FIG. 1.
Figure 4:
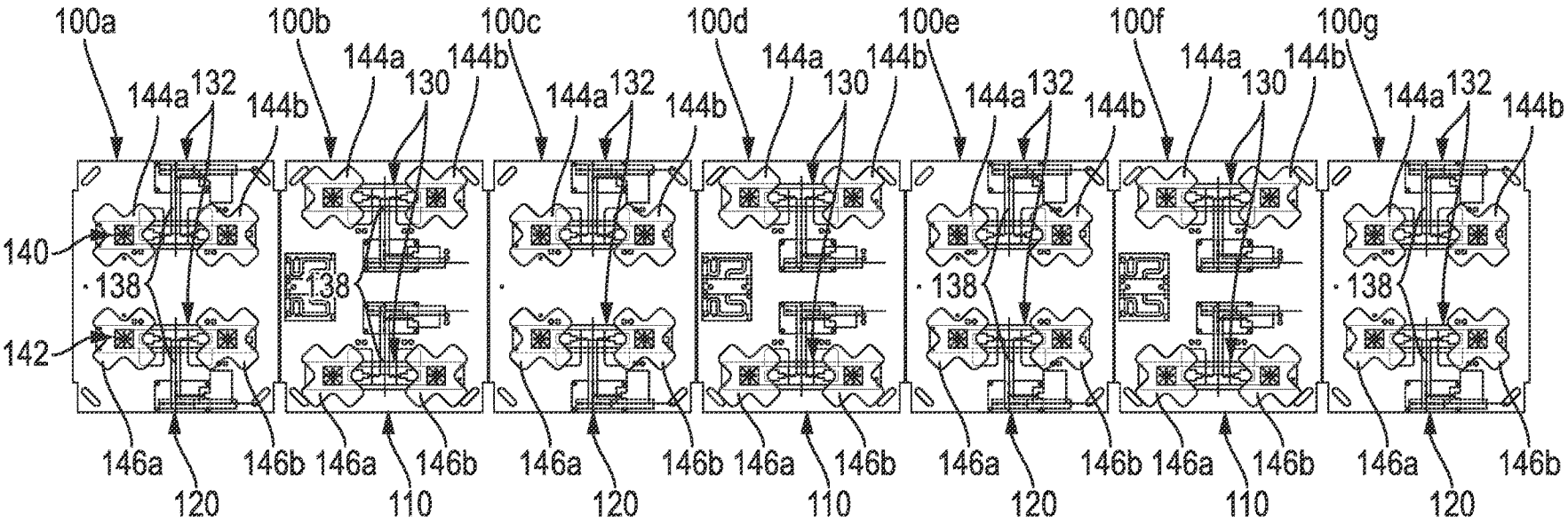
FIG. 4 is a plan view of the HPLP telecommunications antenna according to the embodiment of FIG. 1.

In FIGS. 2-4, the telecommunications antenna 100 comprises a plurality of modules or unit cells 100*a*-100*g* which alternate along the length of the antenna 100. More specifically, the antenna 100 comprises a plurality of first and second unit cells 110, 120, each having a combination high and low-band radiators 130, 132. In the described embodiment, the antenna 100 comprises as many as seven unit cells 100*a*-100*g* wherein the unit cells 100*a*, 100*g* at each end are identical and the unit cells therebetween 100*b*-100*f* consecutively alternate from a first arrangement or configuration in each of the first unit cells 110 to a second arrangement or configuration in each of the second unit cells 120. The alternating radiators 130, 132 within adjacent cells 110, 120 are configured such that the radiator output combines to yield an array factor in the azimuth plane of the antenna. In discussions of principal plane patterns, or even antenna patterns, one frequently encounters the terms "azimuth plane" or "elevation plane" patterns. The term azimuth is commonly used when referencing "the horizon" or "the horizontal." This array factor yields a radiation pattern in the azimuth plane which rolls-off quickly, or more abruptly, to avoid, mitigate or minimize PIM interference in and from adjacent sectors, i.e., or sector antennas. In the described embodiment, the array factor is controlled by the azimuth spacing which causes a fast roll-off in the azimuth direction employing a 3 dB 60 degree beamwidth of RF energy.

In FIGS. 1-6, each of the first and second unit cells 110, 120 include at least one pair of low-band radiators 130, 132 and two pairs of high-band radiators 140, 142. Each of the low-band radiators 130, 132 have a substantially L-shaped configuration while each of the high-band radiators 140, 142 form a paired cruciform configuration. In the described embodiment, the low-band corresponds to frequencies in the range of between about 496 MHz to about 960 MHz while the high-band corresponds to frequencies in a range of between 1700 MHz to about 3300 MHz. The arrangement of the low and high-band radiators 130, 132, 140, 142 differs from one unit cell 110 to an alternating, adjacent unit cell 120. While the low- and high-band radiators 130, 132, 140, 142 may comprise any electrical configuration, the low- and high-band radiators 130, 132, 140, 142 are preferably dipoles. However, the high-band radiators 140, 142 may alternately comprise patch or other stacked/spaced conductive radiators.

Figure 5:
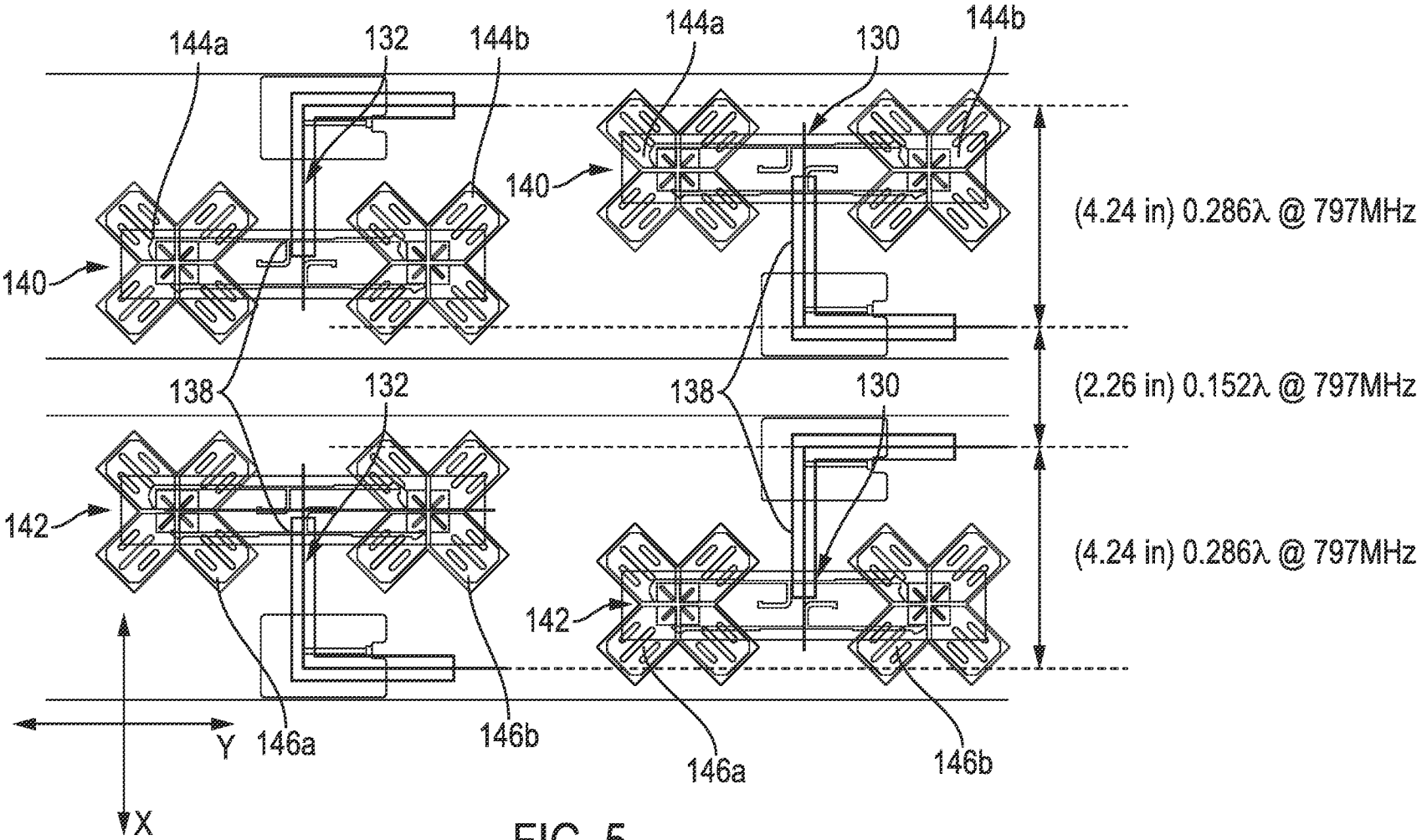
FIG. 5 depicts an enlarged broken-away plan view of two adjacent cells illustrating the spacing/offset dimension between low-band radiators of the telecommunications antenna.
Figure 6:
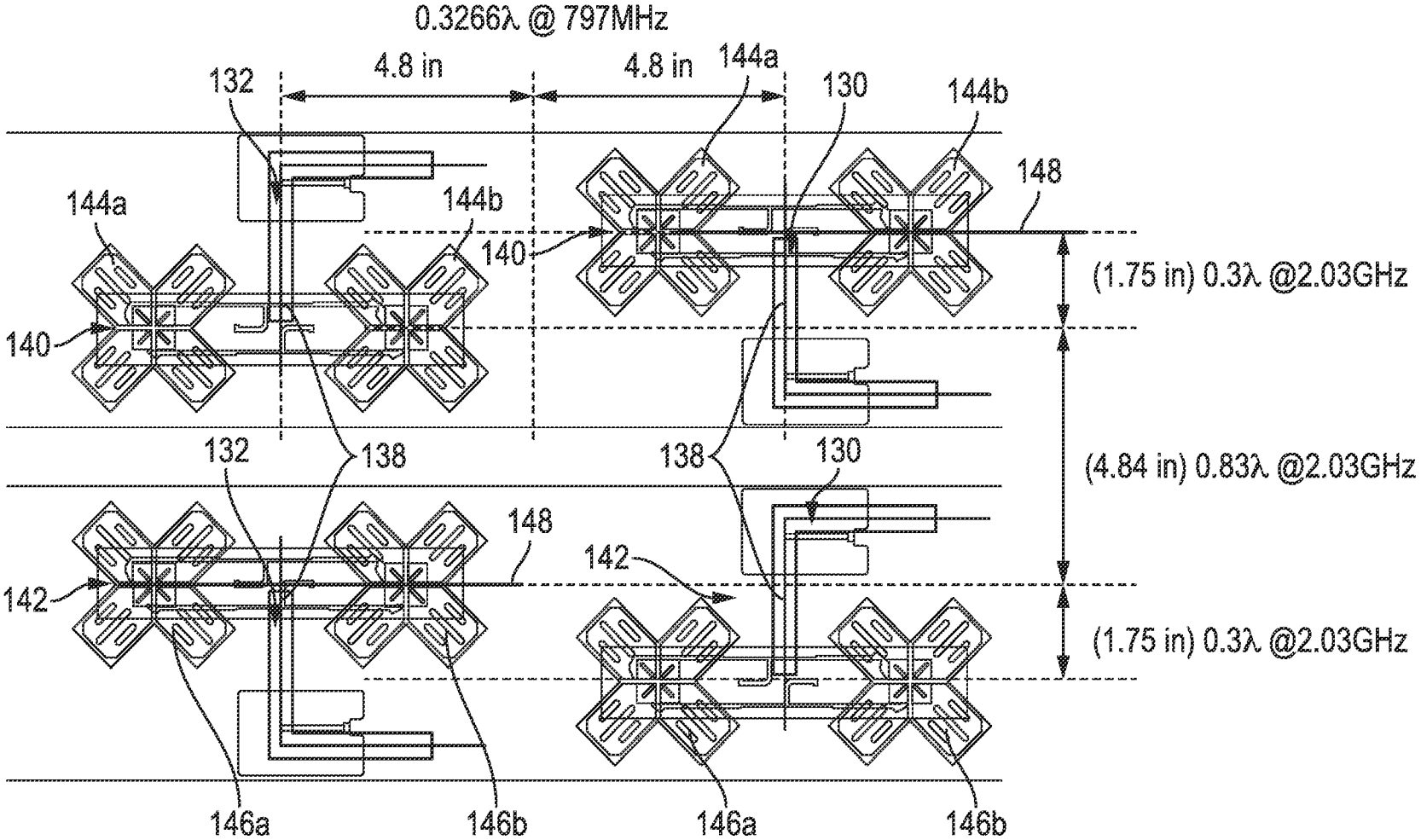
FIG. 6 depicts an enlarged broken-away plan view of two adjacent cells illustrating the pitch dimension between the low-band dipole and the spacing/offset dimension between high-band radiators.
Figure 7:
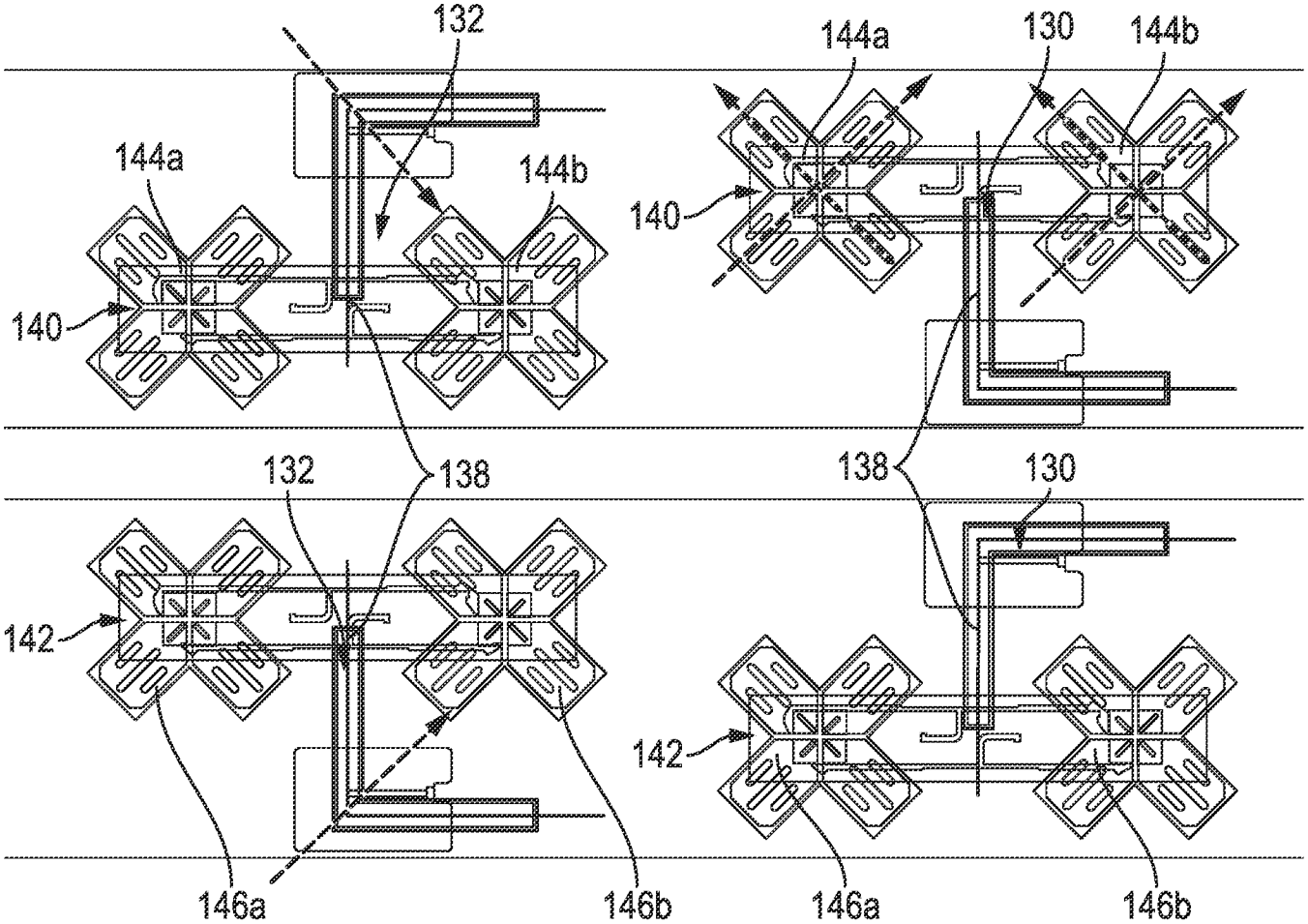
FIG. 7 depicts an enlarged broken-away plan view of two adjacent cells illustrating the cross-polarization between cells and the interaction of the low and high-band radiators.
Figure 8:
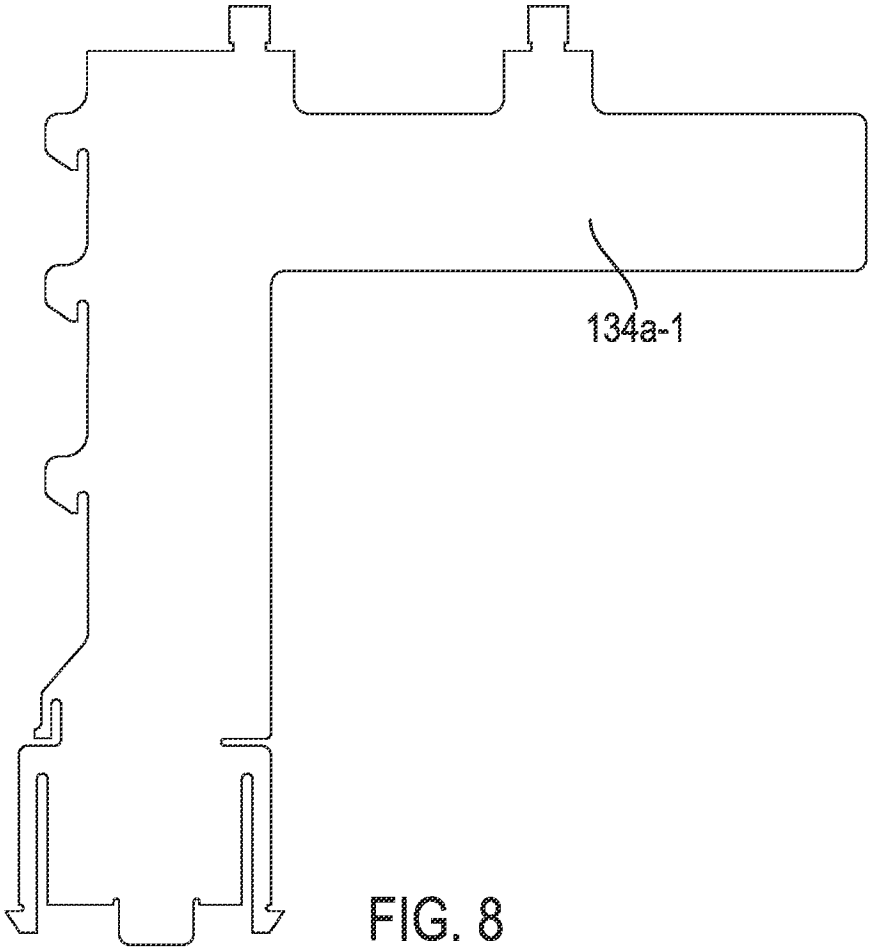
FIG. 8 is an isolated profile view of a first low-band dipole stem.
Figure 9:
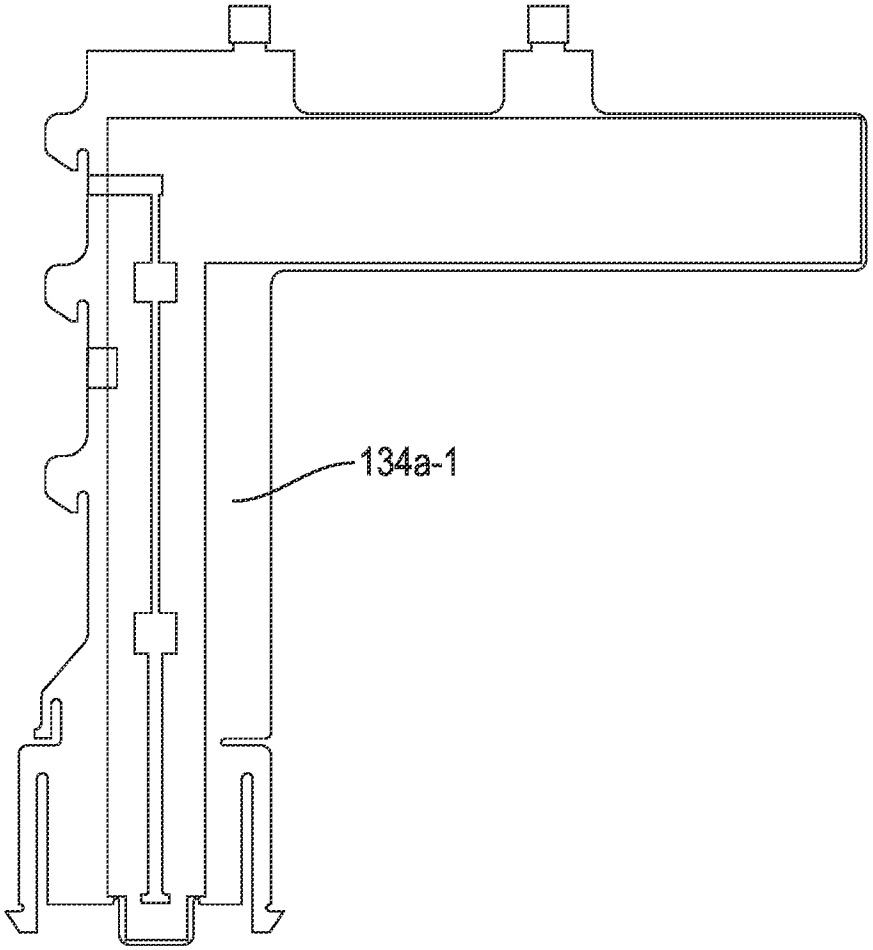
FIG. 9 is an isolated profile view of a second low-band dipole stem orthogonally disposed relative to the first low-band dipole stem.
Figure 10:
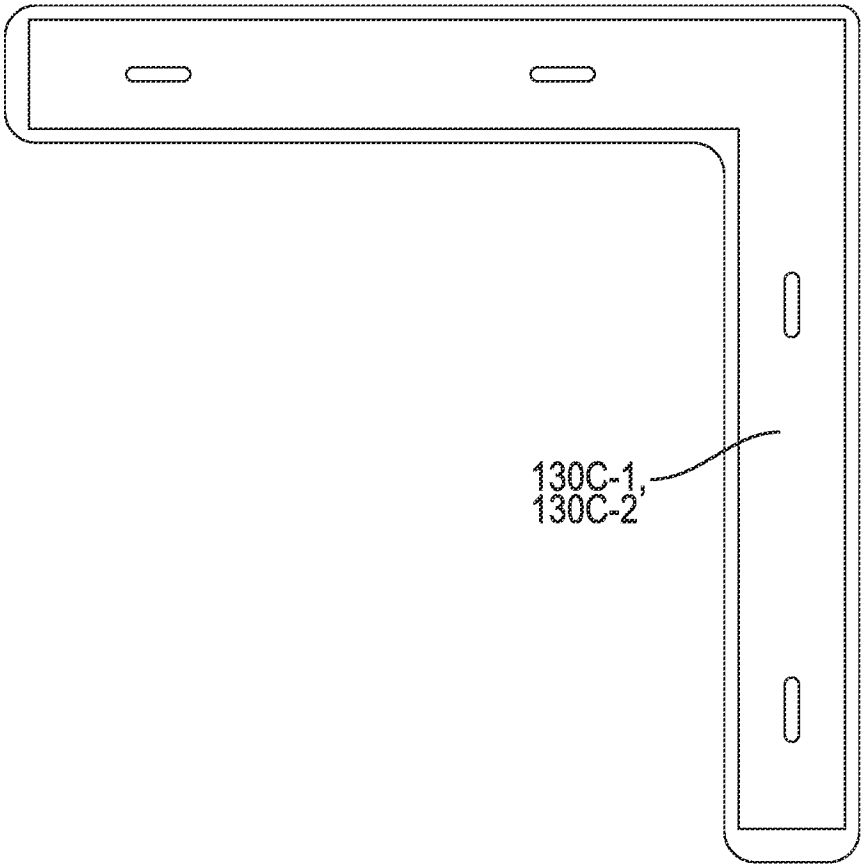
FIG. 10 is a top view of a parasitic radiator operative to join pairs of the first low-band stems to form an L-shaped low-band radiator.
Figure 11:
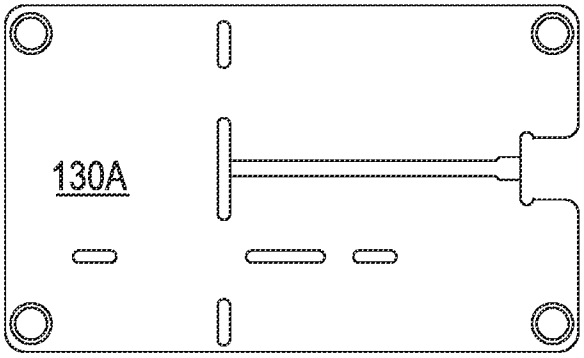
FIG. 11 is an isolated plan view of the base plate for the first and second low-band dipole stems shown in FIGS. 8 and 9.
Figure 12:
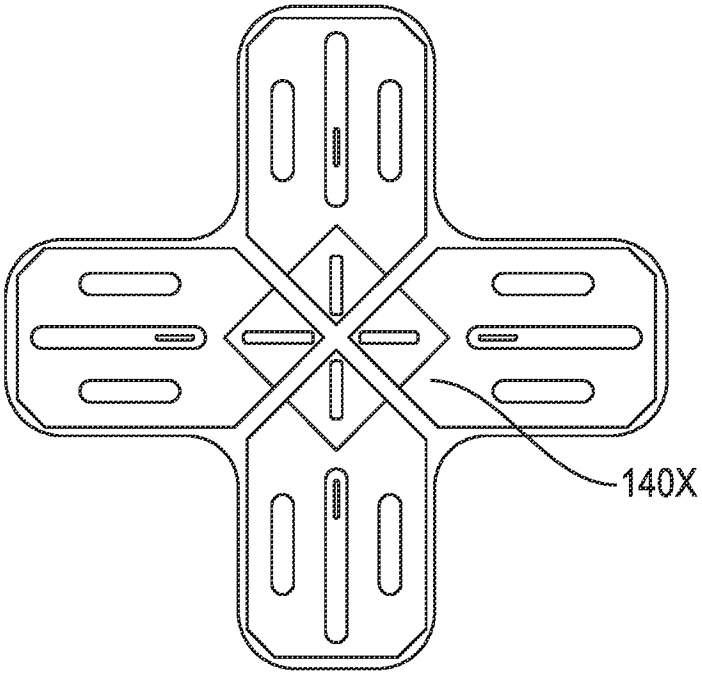
FIG. 12 is an isolated plan view of a cruciform-shaped high-band radiator.
Figure 14:
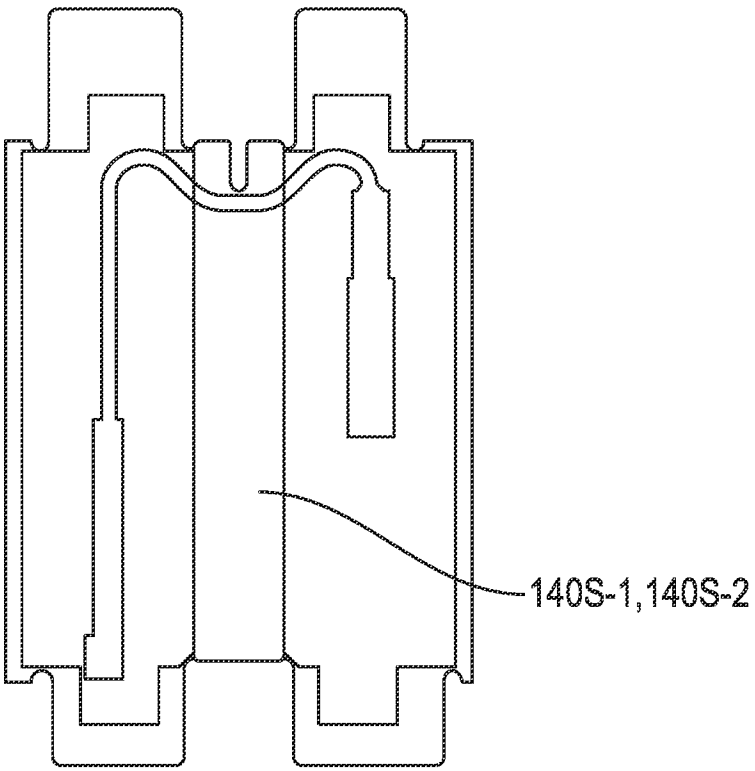
FIG. 14 is an isolated profile view of a second high-band dipole stem corresponding to the cruciform-shaped high-band dipole shown in FIG. 12.
Figure 13:
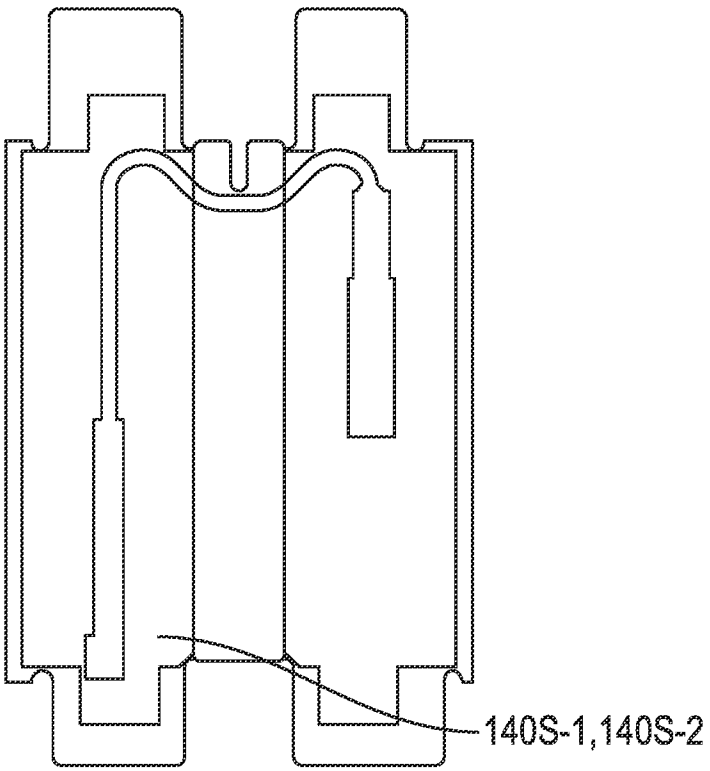
FIG. 13 is an isolated profile view of one of the high-band dipole stems corresponding to the cruciform-shaped high-band radiator shown in FIG. 12.
Figure 15:
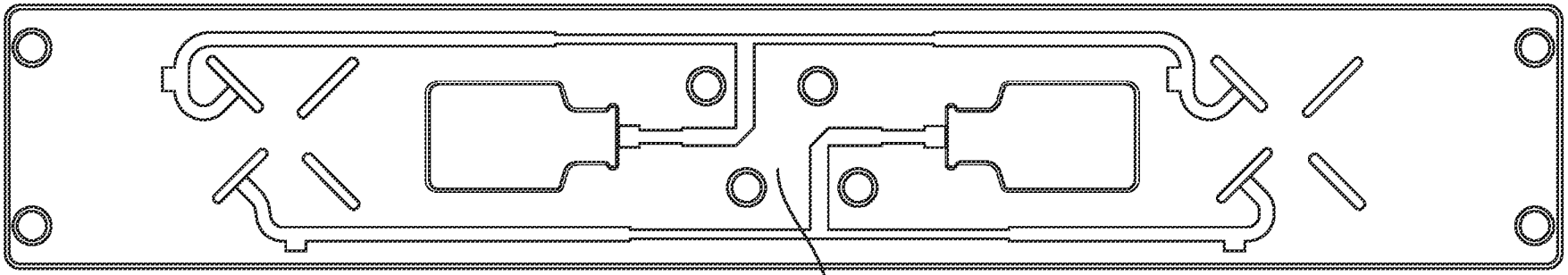
FIG. 15 is an isolated plan view of the subarray base in connection with a pair of high-band radiators.

A first pair of low-band radiators 130, best seen in FIGS. 5 and 6, comprise back-to-back, L-shaped, dipoles 134*a*, 134*b* while a second pair of low-band radiators 132, comprise face-to-face, L-shaped, dipole, radiators 136*a*, 136*b*. An arm of each L-shaped, low-band dipole 130, 132 bifurcates a pair of cruciform-shaped, high-band dipoles 140, 142 along a line 138. Furthermore, with respect to the first unit cells 110, the high-band, dipole or patch radiators 140, 142 and are disposed outboard of the L-shaped, low-band dipoles 130, 132, i.e., toward the outboard edges of the sector antenna 100. With respect to the second unit cells 120, the high-band, radiators 140, 142 are disposed inboard of the L-shaped, low-band, dipoles 130, 132, i.e., between the vertical stems thereof.

Each of the unit cells 110, 120 comprises at least one pair of L-shaped, low-band, dipoles 130 or 132 and two pairs of cruciform-shaped, high-band radiators 140, 142. Furthermore, each of the unit cells 110, 120 comprises a total of two (2) L-shaped, back-to-back dipoles 134*a*, 134*b* or two (2) face-to-face low-band, dipoles 136*a*, 136*b*. Additionally, each of the unit cells 110, 120 comprises a total of four cruciform shaped, high-band radiators 144*a*, 144*b*, 146*a*, 146*b*.

For the purposes of establishing a frame of reference, a Cartesian coordinate system 150 is shown in FIGS. 2 and 5 wherein the offset spacing, or X-dimension of the reference system corresponds to a vertical line in the drawing, the pitch or Y-dimension corresponds to the horizontal dimension of the reference system, and the depth, or Z-direction corresponds to the dimension out-of-the-plane of the page. The azimuth spacing/offset and pitch dimensions between the first and second unit cells 110, 120 can be best be seen in FIGS. 5 and 6. More specifically, the azimuth spacing/offset, or X-dimension, between the L-shaped, low-band, dipoles is the summation between 4.24+2.26 or a total 6.50. The array factor producing this azimuth spacing corresponds to an offset between about 6.20 inches to about 6.8 inches. Alternatively, the array factor producing this azimuth spacing corresponds to an offset of between about 0.40λ to about 0.48λ @ a mean low-band frequency of 797 MHz. In the described embodiment, the azimuth spacing corresponds to an offset of 0.44λ.

FIGS. 5 and 6 show the pitch spacing between the low- and high-band radiators 130, 132, 140, 142. The pitch spacing between the low-band radiators 134*a*, 134*b*, 136*a*, 136*b* from the first unit cell 110 to a second adjacent unit cell 120 is 9.68 inches. The pitch spacing as a function of wavelength A is within a range of between about 0.34λ and 0.40λ and is 0.326λ @ a mean low-band frequency of 797 MHz. The pitch spacing between one of the low-band operators 134*a*, 134*b* and one of the cruciform radiators 144*a*, 144*a* (i.e., in one of the pairs of high-band radiators 140, 142 within the same unit cell) is 2.4 inches or about 0.162λ @ a mean low-band frequency of 797 MHz.

The offset spacing between the pairs of high-band radiators 140, 142 in a first unit cell 110 is 4.84 inches. This corresponds to an offset spacing of about 0.83λ @ a mean high-band frequency of 2030 MHz. The offset spacing between the pairs of high-band radiators 140, 142 in the second unit cell 120 is 8.25 inches (4.84"+3.50.") This corresponds to an offset spacing of about 1.43λ @ a mean high-band frequency of 2030 MHz. The offset spacing between one of the low-band radiators 130 or 132 (measured from a corner of the L-shaped radiator) in either of the unit cells 110, 120 to the centerline 148 of one of the high-band radiators 140, 142 is within a range of between about 3.5 inches to 4.1 inches. This corresponds to an offset spacing within a range of about 0.57λ and 0.63λ or about 0.6λ @ a mean high-band frequency of 2030 MHz. In the described embodiment, the offset spacing is 3.75 inches @ a mean high-band frequency of 2030 MHz.

Finally, the Aspect Ratio (AR) of the telecommunications antenna 100 is approximately 10:1. In the described embodiment, the total length (L) of the telecommunications antenna 100 is about 64.9 inches when summing the length of all seven modules 100*a*-100*g*, or unit cells 110, 120.

FIGS. 8-15 depict the various elements which comprise each of the low- and high-band, dipoles 134*a*, 134*b*, 136*a*, 136*b*, 144*a*, 144*b*, 146*a*, and 146*b*. With respect to the low-band dipoles 130, 132, the elements which comprise one of these include: (i) first and second low-band dipole stems 134*a*-1, 134*a*-2 depicted in FIGS. 8 and 9, respectively, (ii) an L-shaped connector plate 130C associated with one of the low-band radiators 130 depicted in FIG. 10, and (iii) a base plate 130B associated with one of the low-band radiators 130 depicted in FIG. 11. With respect to the high-band dipoles 140, 142, the elements which comprise one of these include: (i) a high-band cruciform radiator plate 140X depicted in FIG. 12), (v) first and second high-band cruciform stems 140S-1 and 140S-2 depicted in FIGS. 13 and 14, respectively and (vi) a high-band cruciform base plate 140B depicted in FIG. 15.

As mentioned above the alternating low-band radiators 130, 132 within adjacent cells 110, 120 are configured such that the radiator output combines to yield an array factor in the azimuth plane of the antenna. This array factor yields a radiation pattern in the azimuth plane which rolls-off quickly, or more abruptly, to avoid, mitigate or minimize PIM interference from adjacent sectors, i.e., sector antennas. In the context used herein, the term fast roll-off radiation pattern means that the azimuth pattern level changes steeply along the lateral edges of the radiation pattern, or at high angles relative to a mechanical boresight.

Figure 16:
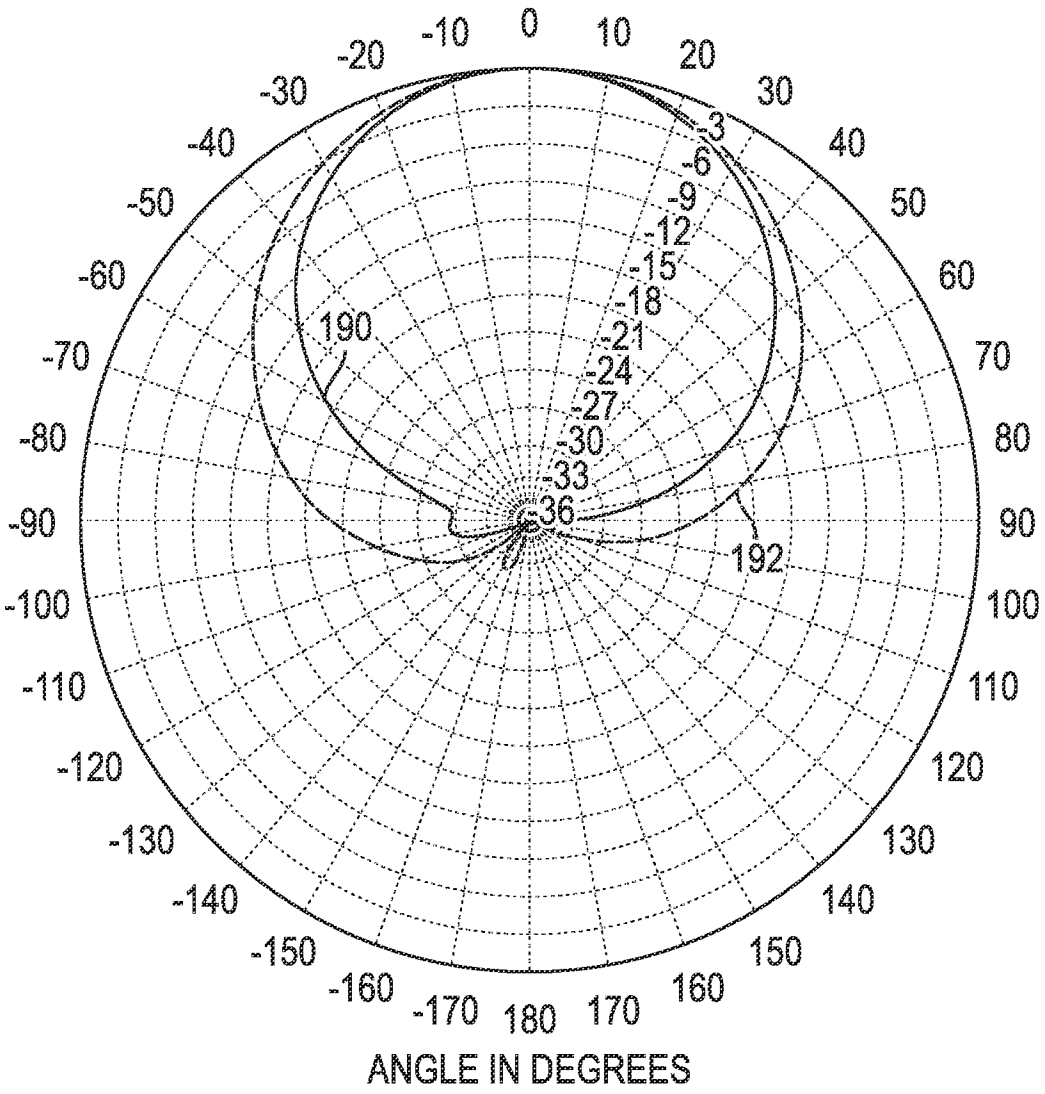
FIG. 16 is an azimuth plot of a fast-roll off radiation pattern produced by the high performance/capacity, low profile (HPLP) telecommunications antenna according to disclosure.

FIG. 16 depicts a fast roll-off radiation pattern 190 compared to a conventional pattern 192 produced by prior art sector antennas for use in base station and cell towers. As mentioned above the fast roll-off pattern tightens the lateral spread of the radiated energy. The faster the roll-off, the more control is provided to prevent interference across adjacent sector antennas. In the described embodiment, the array factor is controlled by the azimuth spacing which causes the fast roll-off pattern 190 in the azimuth direction when employing a 3 dB, 60 degree beamwidth of RF energy.

The low-band radiators 130, 132 are also spaced-away from the high-band radiators 140, 142 to mitigate shadowing. More specifically, it will be appreciated that the cruciform-shaped high-band radiators define a substantially polygonal-shaped region corresponding to the planform area of each cruciform plate. More specifically, the cruciform defines a bounded area which produces a substantially square shaped region. In the described embodiment, an arm of each of the L-shaped radiators is caused to bifurcate, yet avoid cross-over or overlap into the planform area defined by the cruciform plates of each high-band radiator. Inasmuch as the arm of the L-shaped radiator does not encroach into the planform area of the cruciform-shaped radiators, shadowing is mitigated and performance improved. In the described embodiment, each of the low-band L-shaped radiators 130, 132 are spaced a distance of at least about 2.4 inches from the high-band radiators 140, 142 to mitigate shadowing.

Figure 17:
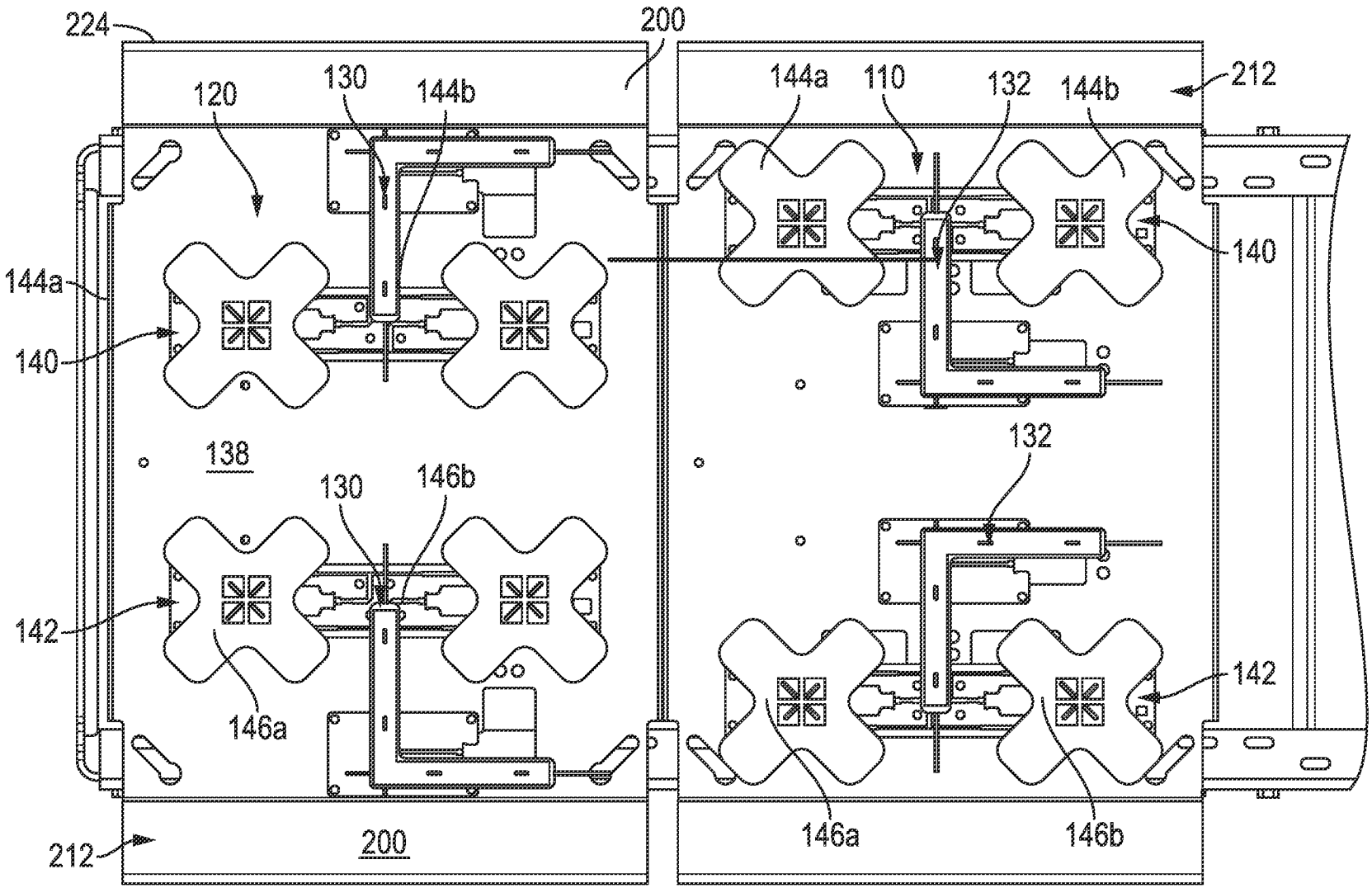
FIG. 17 is a partially broken away plan view of the alternating cells each having at least one pair of low-band dipoles and two pairs of high-band dipoles, (i) the first pair of low-band dipoles forming face-to-face L-shaped radiators, (ii) the second pair of low-band dipoles forming back-to-back L-shaped radiators, (iii) the base of each L-shape dipole bifurcating a pair of cruciform high-band dipoles, and (iv) the high-band cruciform dipole being disposed outboard of the low-band dipole stems in the first cell and inboard of the low-band dipole stems in the second cell.
Figure 18:
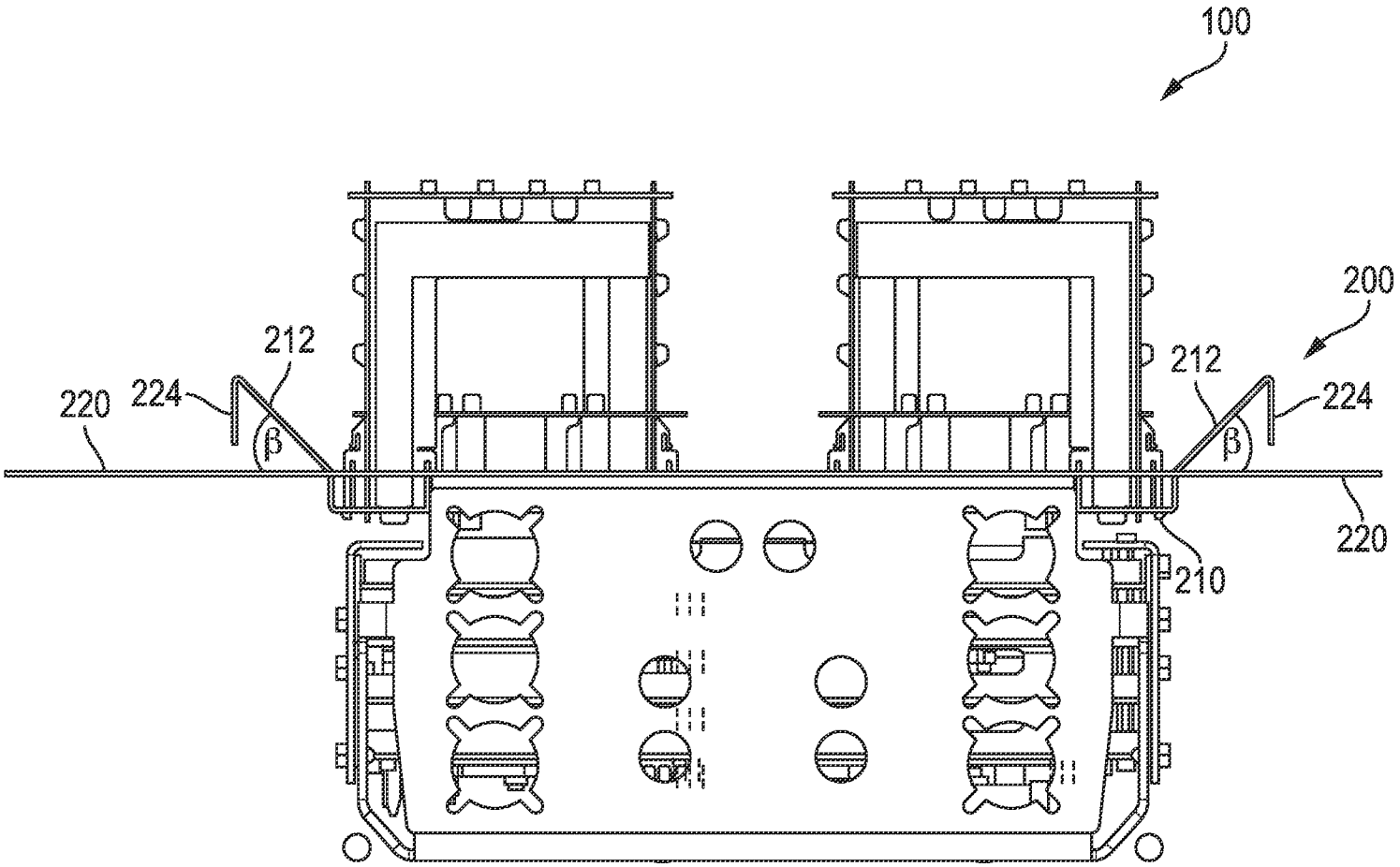
FIG. 18 depicts an electrical reflector/fairing structure extending laterally outboard of the low and high-band dipole to concentrate the radiation pattern in a desired direction.

FIGS. 1, 17 and 18 depict a reflector 200 which concentrates the roll-off without influencing other electrical properties of the telecommunications antenna 100. The reflector 200 mounts to an edge 210 of the high aspect ratio antenna 100 and includes an inclined portion 212 forming an angle β of approximately +/−forty-five degrees (+/−45°) relative to a horizontal plane 220, i.e., in FIG. 21. The reflector 200 is stiffened by an integral flange 224 which is integral with, and projects downwardly from, the apex of the inclined portion 212 of the reflector 200. The flange provides sufficient rigidity to prevent the reflector 200 from high frequency vibrations and the attendant noise which invariably will occur, i.e., as a consequence of winds and rain due to inclement weather.

Figure 19:
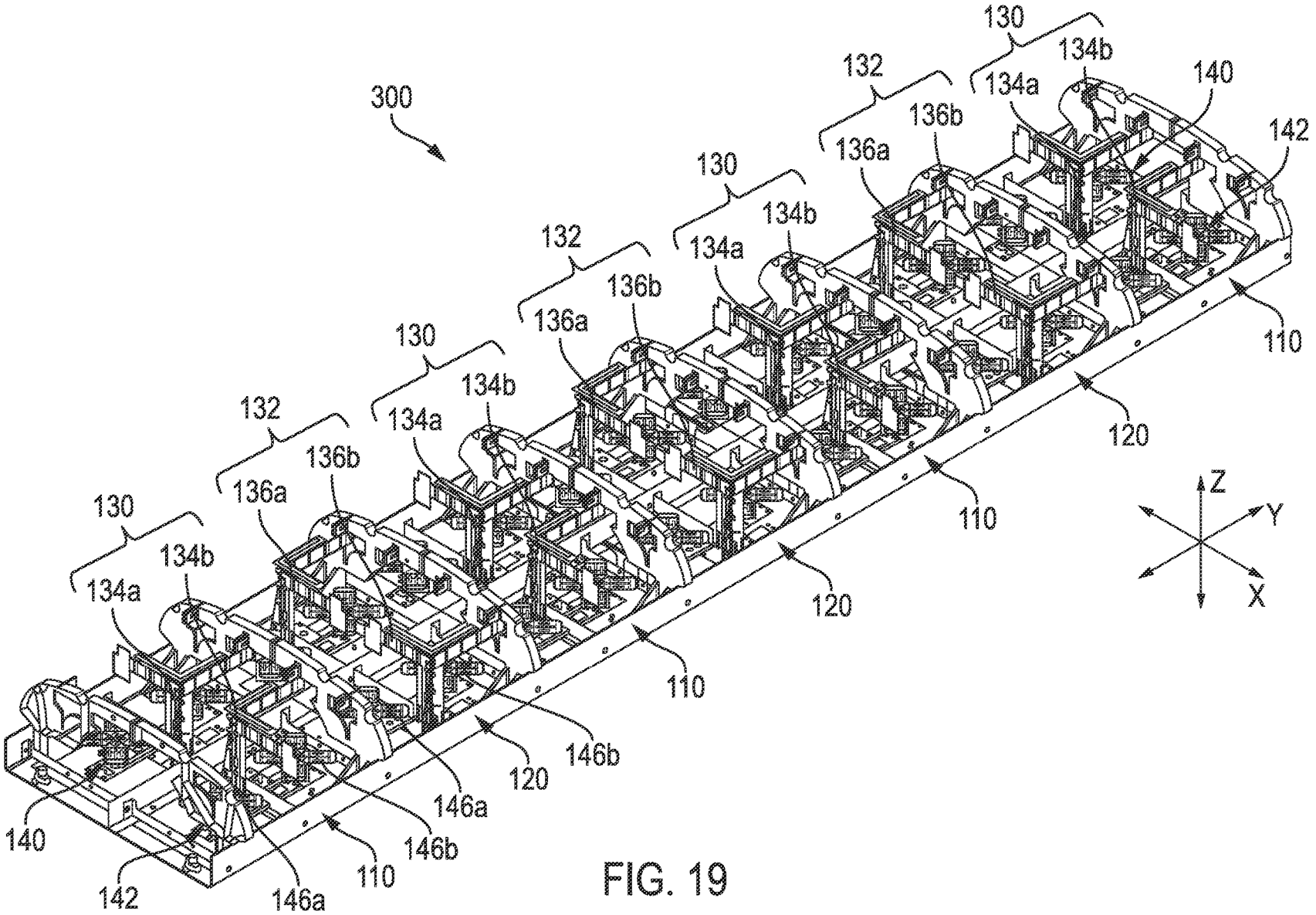
FIG. 19 is a perspective view of another embodiment of the high performance, low profile (HPLP) telecommunications antenna wherein a first radiator is segmented and electrically-connected to filter undesirable resonances due to, or originating from, the signal transmission associated with a second radiator in close proximity to the first radiator.
Figure 20:
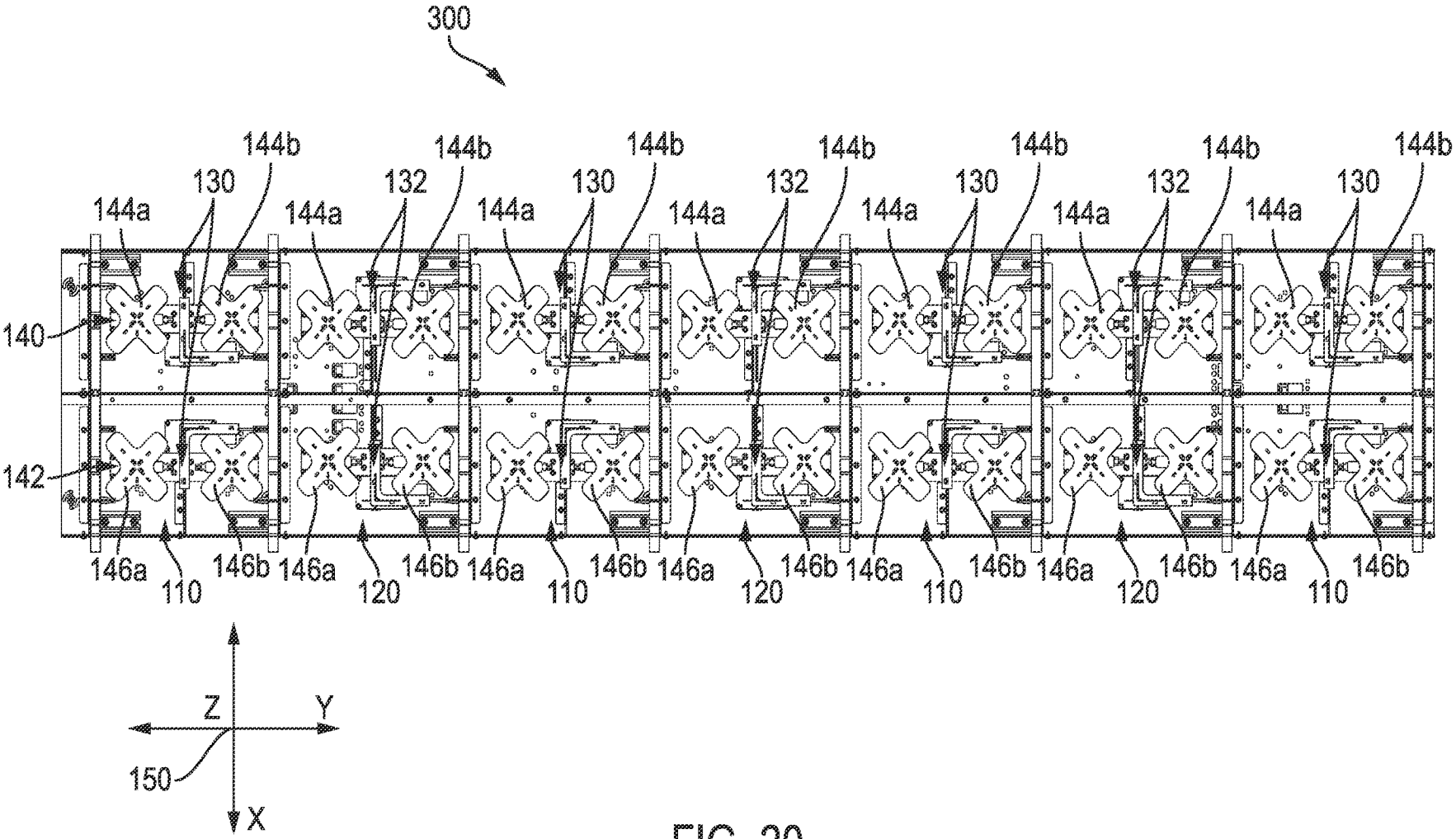
FIG. 20 is a plan view of the HPLP telecommunications antenna depicted in FIG. 19.
Figure 21:
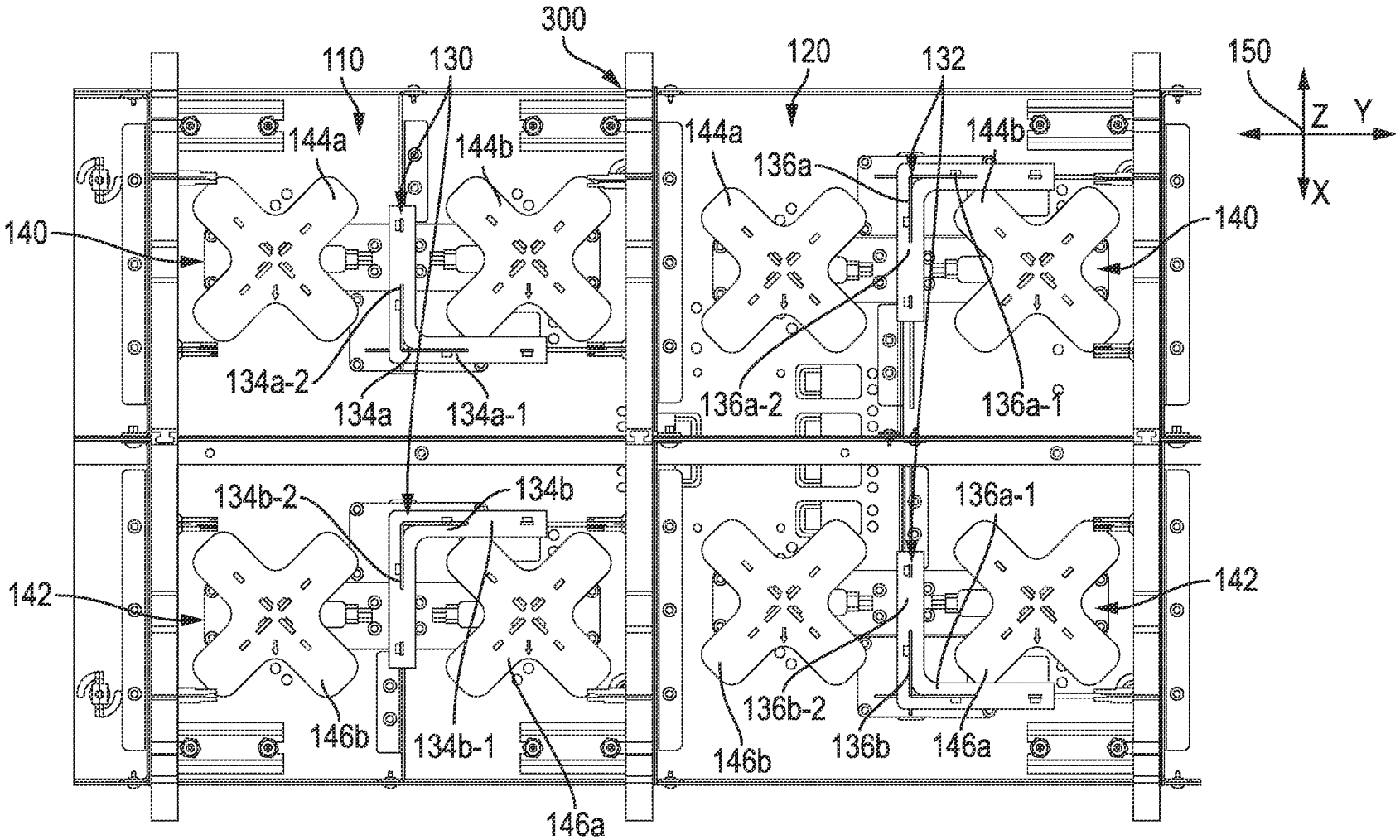
FIG. 21 depicts an enlarged broken-away plan view of two adjacent cells illustrating the spacing/offset dimension between low-band radiators and the pitch dimension between high-band radiators of the telecommunications antenna.

FIGS. 19-21 depict yet another embodiment of the high performance, low profile (HPLP) telecommunication antenna 300 wherein at least one of the radiators 130, 132, 140, 142 is segmented into electrically-connected radiator elements to suppress a resonance response therein upon activation of the other of the radiators 130, 132, 140, 142. In this embodiment, the telecommunications antenna 300 shown in FIGS. 19-21 includes seven (7) unit cells 110, 120, however, this embodiment includes a first unit cell 110 at each end of the antenna 300 and alternating first and second unit cells 110, 120, therebetween. It will be recalled that the telecommunications antenna 100 depicted in FIGS. 2-4, includes a second unit cell 120 at each end and alternating first and second unit cells 110, 120 therebetween.

Similar to the previous embodiment, the telecommunication antenna 300 comprises as many as seven (7) unit cells 100*a*-100*g* wherein the unit cells 100*a*, 100*g* at each end are identical and the unit cells therebetween 100*b*-100*f* consecutively alternate from a first arrangement or configuration in each of the first unit cells 110 to a second arrangement or configuration in each of the second unit cells 120. The radiators 130, 132 within adjacent cells 110, 120 are configured such that the radiator output combines to yield an array factor in the azimuth plane of the antenna. This array factor yields a radiation pattern in the azimuth plane which rolls-off quickly, or more abruptly, to avoid, mitigate or minimize PIM interference from adjacent sectors, i.e., or sector antennas.

Furthermore, each of the first and second unit cells 110, 120 include at least one pair of low-band radiators 130, 132 and two pairs of high-band radiators 140, 142. Each of the low-band radiators 130, 132 have a substantially L-shaped configuration while each of the high-band radiators 140, 142 form a paired cruciform configuration. The low-band radiators 130 in the first unit cells 110 are back-to-back while those radiators 132 in the second unit cells 120 are face-to-face. Each of the L-shaped dipoles 130, 132 bifurcate the adjacent high-band radiators 140, 142 of the respective cell 110, 120.

In the described embodiment, the low-band corresponds to frequencies in the range of between about 496 MHz to about 960 MHz while the high-band corresponds to frequencies in a range of between about 1700 MHz to about 3300 MHz. In the described embodiment, the low-band corresponds to a frequency of about 800 MHz while the high-band corresponds to a frequency of about 1910 MHz. The arrangement of the low and high-band radiators 130, 132, 140, 142 differs from one unit cell 110 to an alternating, adjacent unit cell 120. While the low- and high-band radiators 130, 132, 140, 142 may comprise any electrical configuration, the low- and high-band radiators 130, 132, 140, 142 are preferably dipoles. However, the high-band radiators 140, 142 may alternately comprise patch or other stacked/spaced conductive radiators.

For the purposes of establishing a frame of reference, a Cartesian coordinate system 150 is shown in FIG. 21 wherein the offset spacing, or X-dimension of the reference system corresponds to a vertical line in the drawing, the pitch or Y-dimension corresponds to the horizontal dimension of the reference system, and the depth, or Z-direction corresponds to the dimension out-of-the-plane of the page. The azimuth spacing/offset and pitch dimensions between the first and second unit cells 110, 120 can be best be seen in FIGS. 19-21. More specifically, the azimuth spacing/offset, or X-dimension, between the L-shaped, low-band, dipoles is the summation between 4.24+2.26 or a total 6.50. This spacing/offset corresponds to the azimuth spacing/offset of the first antenna 100 as depicted and earlier described in FIGS. 5 and 6.

The array factor producing this azimuth spacing corresponds to an offset between about 6.20 inches to about 6.8 inches. Alternatively, the array factor producing this azimuth spacing corresponds to an offset of between about 0.40λ to about 0.48λ @ a mean low-band frequency of 797 MHz. In the described embodiment, the azimuth spacing corresponds to an offset of 0.44λ.

FIG. 21 shows the pitch spacing between the low- and high-band radiators 134*a*, 134*b*, 136*a*, 136*b*, 144*a*, 144*b*, 146*a*, and 146*b*. The pitch spacing between the low-band radiators 134*a*, 134*b*, 136*a*, 136*b* from the first unit cell 110 to a second adjacent unit cell 120 is 9.68 inches. The pitch spacing as a function of wavelength is within a range of about 0.34λ and 0.40λ and is 0.326λ @ a mean low-band frequency of 797 MHz. The pitch spacing between one of the low-band operators 134*a*, 134*b* and one of the cruciform radiators 144*a*, 144*a* (i.e., in one of the pairs of high-band radiators 140, 142 within the same unit cell) is 2.4 inches or about 0.162λ @ a mean low-band frequency of 797 MHz.

The offset spacing between the pairs of high-band radiators 140, 142 in a first unit cell 110 is 4.84 inches. This corresponds to an offset spacing of about 0.83λ @ a mean high-band frequency of 2030 MHz. The offset spacing between the pairs of high-band radiators 140, 142 in the second unit cell 120 is 8.25 inches (4.84"+3.50"). This corresponds to an offset spacing of about 1.43λ @ a mean high-band frequency of 2030 MHz. The offset spacing between one of the low-band radiators 130 or 132 (measured from a corner of the L-shaped radiator) in either of the unit cells 110, 120 to the centerline 148 of one of the high-band radiators 140, 142 is within a range of between also 3.5 inches to 4.1 inches. This corresponds to an offset spacing within a range of about 0.57λ and 0.63λ or about 0.6λ @ a mean high-band frequency of 2030 MHz. In the described embodiment, the offset spacing is 3.75 inches @ a mean high-band frequency of 2030 MHz.

In FIGS. 21-25, each of the low-band dipoles radiators 130, 132 comprises orthogonal dipole stems 134*a*-1, 134*a*-2, 136*a*-1, 136*a*-2. For example, one of the back-to-back dipole radiators 130 comprises an axially-oriented dipole stem 134*a*-1 parallel to the X-axis of the Cartesian coordinate system 150 and a transversely-oriented dipole stem 134*a*-2 parallel to the Y-axis of the reference system 150.

Figure 22:
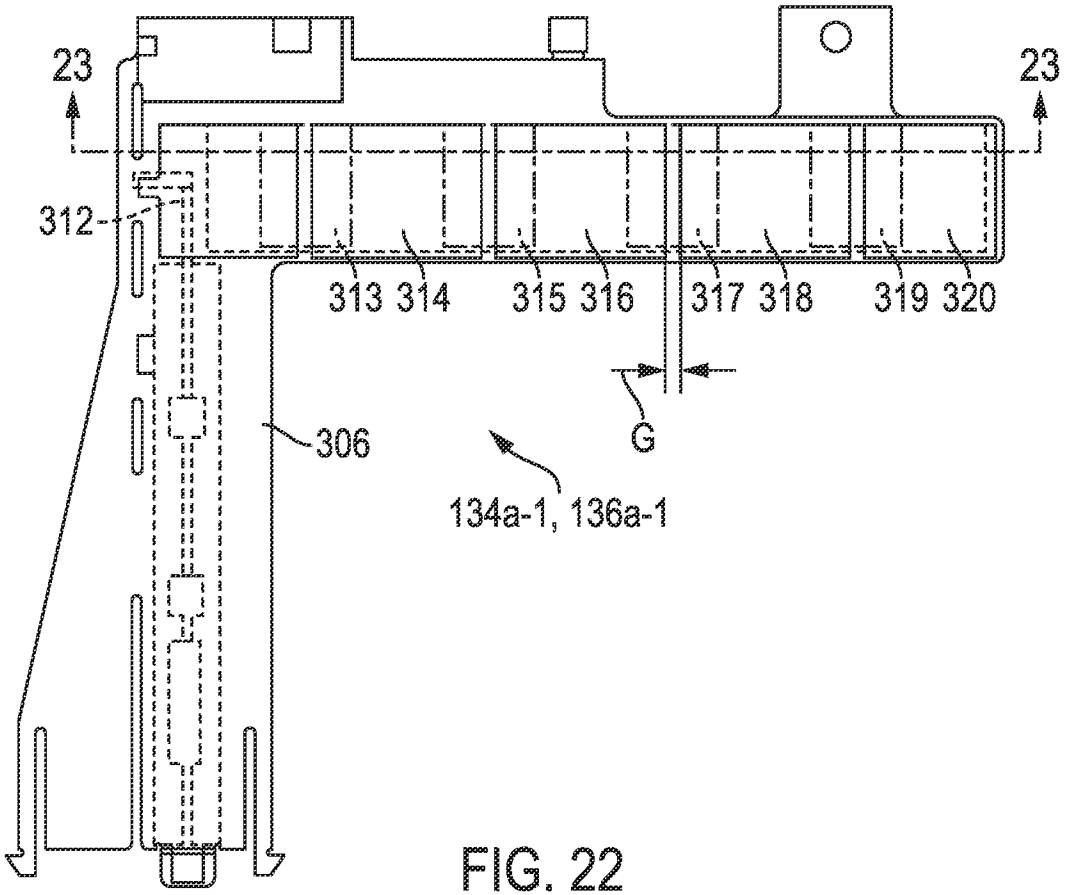
FIG. 22 is an isolated profile view of a first dipole stem of one of the L-shaped low-band dipole radiators including a first plurality of low-band radiator elements separated by a dielectric gap, and a second plurality of coupling elements disposed across the dielectric gap to electrically-couple the radiator elements.
Figure 23:
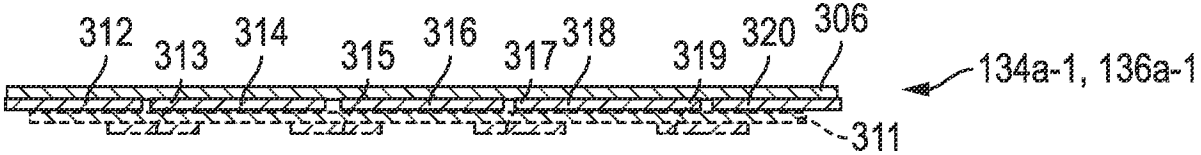
FIG. 23 is a cross-sectional view of the first plurality of low-band radiator elements taken substantially along line 23-23 of FIG. 22.

In FIGS. 22 and 23, the axially-oriented dipole stem 134*a*-1 comprises a generally right-angled, non-conductive, substrate material 306 upon which segmented conductive radiator elements, patches, or traces 312, 314, 316, 318, 320 are printed, affixed or adhered. At least one of the conductive radiator elements 312, 314, 316, 318, 320 is electrically connected to the conductive ground plane of the antenna 100. Each of the elements 312, 314, 316, 318, 320 is separated by a small dielectric gap to prevent direct current flow across the radiator elements 312, 314, 316, 318, 320. In the described embodiment, the low-band radiator 130 includes five (5) low-band radiator elements 312, 314, 316, 318, 320 which are each separated by a small dielectric gap G, i.e., on the order of 0.08 inches. While direct current flow is inhibited by the gap G, the elements 312, 314, 316, 318, 320, are electrically connected by a plurality of coupling elements 313, 315, 317, 319 which bridge each of the gaps G. In the described embodiment, four (4) coupling elements 313, 315, 317, 319 are disposed over the edges of each of the radiator elements 312, 314, 316, 318, 320, but are not intended to make direct electrical contact along the mating interface. Rather, a capacitive flux field is established to cause the radiator elements 312, 314, 316, 318, 320 to function as a unitary element without inducing a resonant response in the low-band radiator, i.e., along with the interference and reduced SINR produced as a consequence of resonance. A bonding material or thin film of epoxy 311 may be disposed between the mating interface of the radiator elements 312, 314, 316,318, 320 and the coupling elements 313, 315, 317, 319 to prevent direct electrical contact across the interface.

Figure 24:
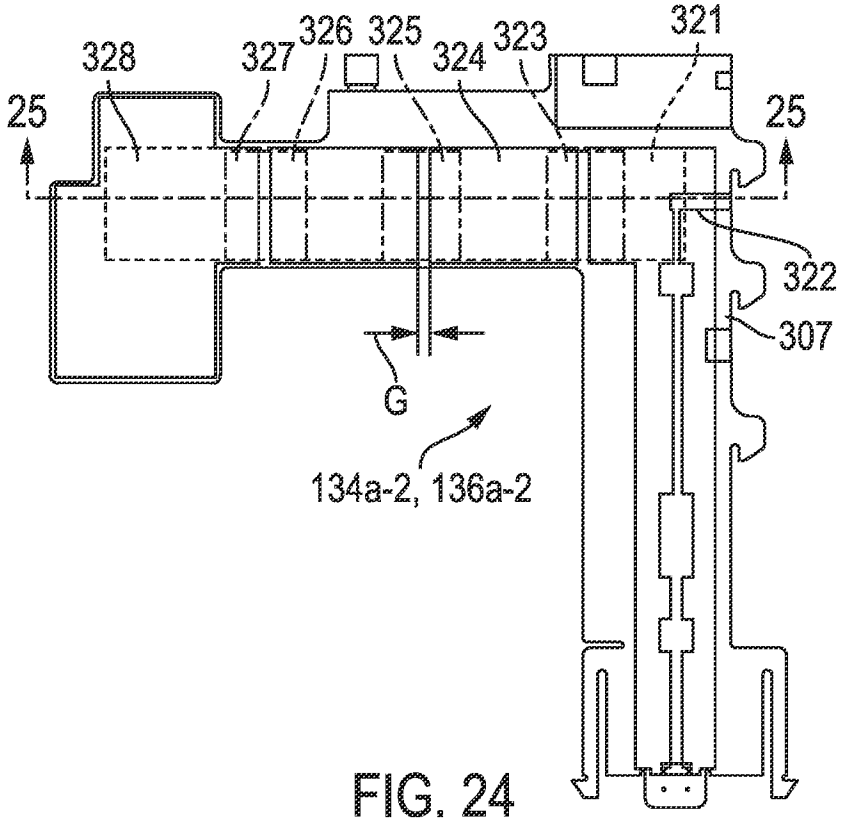
FIG. 24 is an isolated profile view of a second dipole stem of an L-shaped low-band dipole radiator including a first plurality of radiator elements separated by a dielectric gap and a second plurality of coupling elements disposed across the dielectric gap to electrically-couple the radiator elements.
Figure 25:
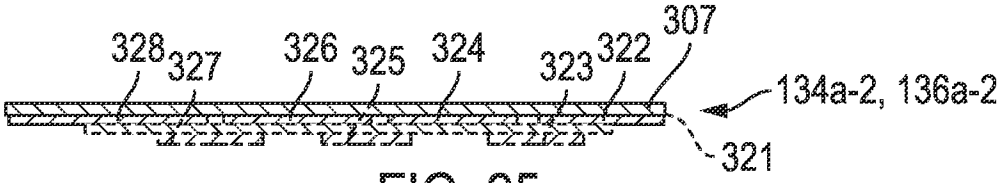
FIG. 25 is a cross-sectional view of the plurality of low-band radiator elements taken substantially along line 25-25 of FIG. 24.

In FIGS. 24 and 25, the other low-band dipole stem 134*a*-2 is similarly constructed and comprises four (4) low-band radiator elements 322, 324, 326, 328 adhered, affixed or printed on a non-conductive substrate 307, separated by three (3) dielectric gaps G. An equal number of coupling elements 323, 325, 327 bridges each gap G to capacitively couple the low-band radiator elements 322, 324, 326, 328. Similar to the other dipole stem 134*a*-1, at least one of the low-band radiator elements 322, 324, 326, 328 is electrically connected to the antenna ground.

Figure 26:
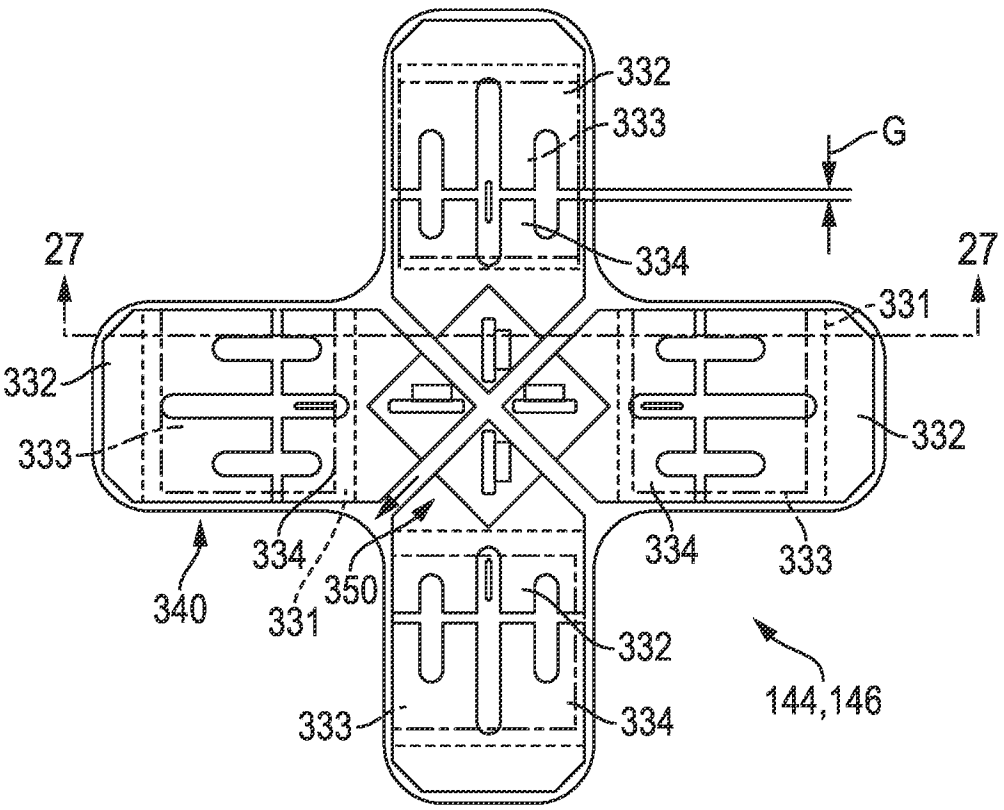
FIG. 26 is an isolated plan view of a high-band radiator including a plurality of high-band radiator elements separated by a dielectric gap, and at least one coupling element bridging the dielectric gap to electrically couple the radiator elements.
Figure 27:
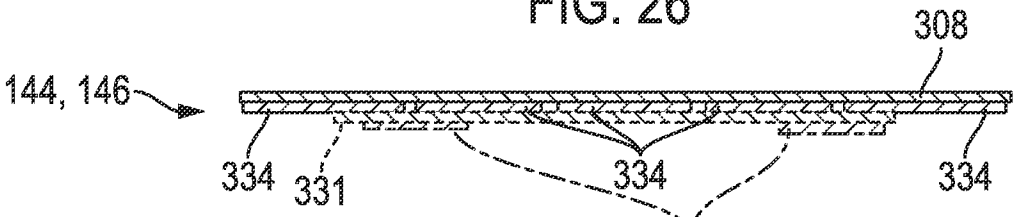
FIG. 27 is a cross-sectional view of the plurality of high-band radiator elements taken substantially along line 27-27 of FIG. 26.

In FIGS. 26 and 27, a high-band dipole radiator 140, 142 comprises a non-conductive, cruciform-shaped substrate material 308 having a plurality of star arms 340 projecting radially from a central hub 350. A plurality of high-band radiator elements 332, 334 is adhered, affixed or printed onto the non-conductive substrate 308 and separated by a dielectric gap G. At least one coupling element 333 bridges the gap G to capacitively couple the high-band radiator elements 322, 324, 326, 328. Similar to the low-band dipoles 130, 132, the central hub 350 of a high-band dipole stem is electrically connected to the antenna ground.

Each of the low-band radiator elements 312, 314, 316, 318, 320, 322, 324, 326, 328 has an effective length corresponding to or less than at least λ/2, however, a smaller effective length may avoid resonances at lower order harmonics, i.e., second, third and fourth order harmonics. While an optimum length of each radiator element can be determined to mitigate resonance and maximize efficiency, high-band radiators should employ radiator elements having an effective length corresponding to a wavelength of less than about λ/4, wherein A is the operating wavelength of an adjacent low-band radiator. Low-band radiators, on the other hand, may employ radiator elements having an effective length corresponding to a wavelength of at less than about λ/7, wherein A is the operating wavelength of the adjacent high-band radiator. While the effective length of the radiator elements 312, 314, 316, 318, 320, 322, 324, 326, 328 corresponds to an effective wavelength of at least about λ/7, even smaller effective lengths, i.e., λ/9-λ/16, may be desirable.

Figure 28:
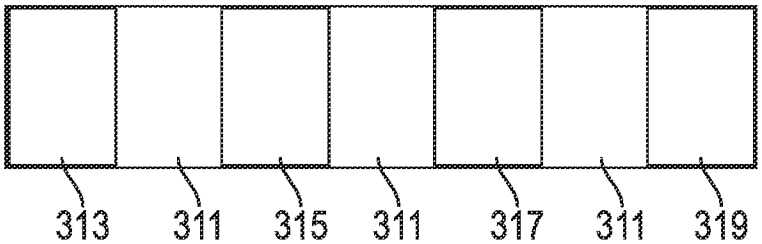
FIG. 28 depicts an isolated plan view of the plurality of conductive elements employed to couple the radiator elements disposed along the dipole stems of the low-band radiators.
Figure 29:
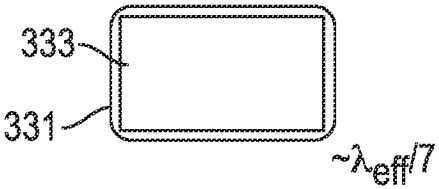
FIG. 29 depicts an isolated plan view of the element employed to couple the radiator elements of the cruciform radiators of the high-band radiator elements.

Finally, FIGS. 28 and 29 depict isolated plan views of the conductive elements 313, 315, 317, 319, and 333 employed to couple the low and high-band radiator elements. In FIG. 28, the coupling elements 313, 315, 317, 319, 323, 325, 327 associated with the low-band radiators 134*a*-1, 134*a*-2, 136*a*-1, 136*a*-2 are held together by a strip of tape 311 which may "snap-on" or "stick-on" to the substrate material 306 or 307 to hold the coupling elements 313, 315, 317, 319, 323, 325, 327 in place relative to the conductive radiator elements 312, 314, 316, 318, 320, 322, 324, 326, 328. In FIG. 29, the coupling element 333 associated with the high-band cruciform radiators 144, 146 is backed by an adhesive strip 331 to hold the coupling element 333 in the proper position relative to the conductive radiator elements 332, 334.

Figure 30A:
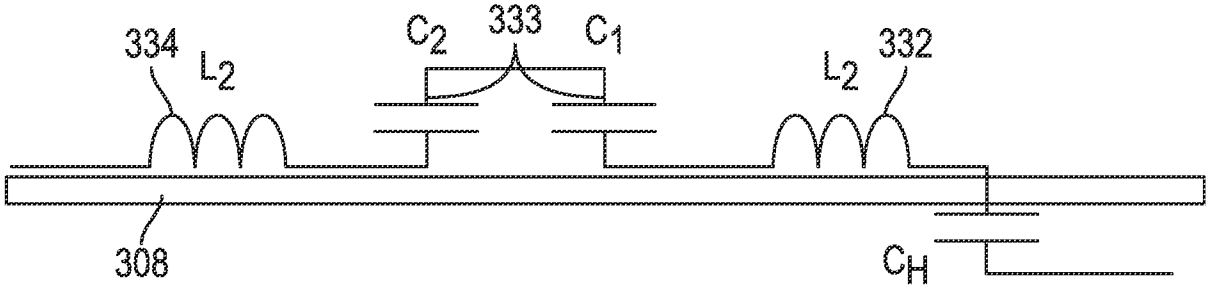
FIGS. 30*a* and 30*b* depict electrical schematics of the connected radiator elements associated with a high-band dipole radiator such as that shown in FIG. 27.
Figure 30B:
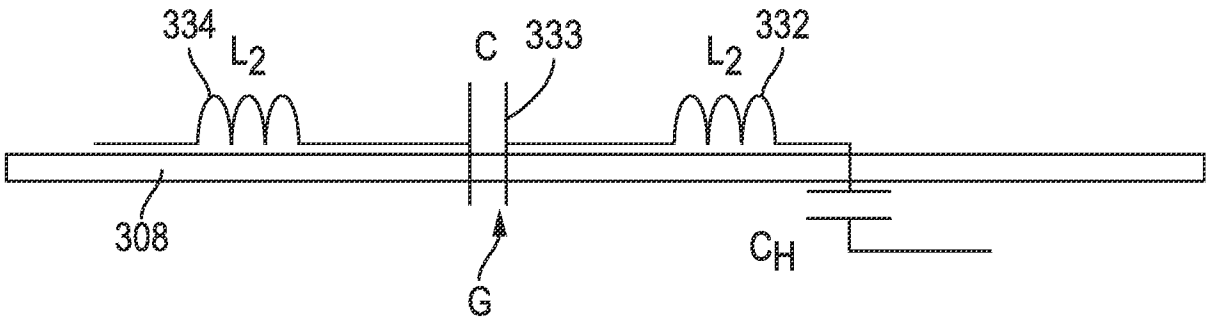
Figure 31:
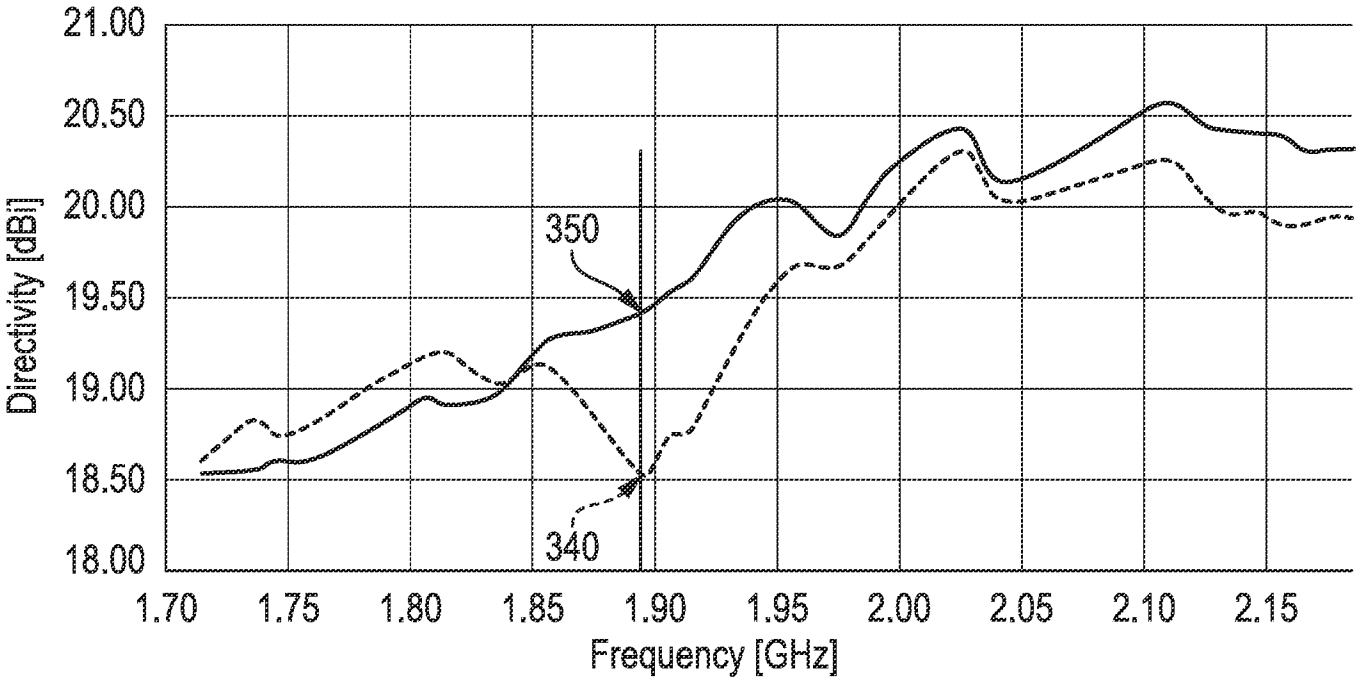
FIG. 31 is a graph of directivity (dBi) vs. frequency (GHz) comparing the frequency response of a high band radiator with and without the implementation of segmented dipole radiator elements.

FIGS. 30*a* and 30*b* depict electrical schematics of the radiator elements 332, 334 which have been capacitively-connected by a coupling element 333 associated with a high-band dipole radiator 140 such as that shown in FIG. 37. In FIG. 40*a*, the radiator elements 332, 334 are each schematically depicted as inductors $L_1$ and $L_2$, while the coupling element 333 is depicted as a pair of capacitors $C_1$ and $C_2$. A first half (½) of the capacitive connection is formed on the left side of the coupling element 333 while a second half (½) of the capacitive connection is formed on the right side of the coupling element 333. In FIG. 31, the radiator elements 332, 334 are each schematically depicted as inductors $L_1$ and $L_2$, while the capacitor C1 connection is schematically represented by the combination of all elements. The capacitive connection includes: (i) the upwardly facing surfaces of each radiator element 332, 334, (ii) the surfaces of the coupling element 33 in register and juxtaposed with the upwardly facing surfaces of each radiator element 332, 334, (iii) the edges of each of the radiator elements 332, 334, and (iv) the intervening gap G between the radiator elements 332, 334. the edges of the coupling elements the coupling element 333, may be viewed as the entire 2 and the other ½ t is apparent that The difference in FIG. From Therein, one can see FIG. 31 is a graph of directivity (dBi) vs. frequency (GHz) comparing the frequency response of a high band radiator with and without the implementation of segmented dipole radiator elements. For clarification purposes, "directivity" relates to the strength or gain of a radiator signal in a particular direction. Generally, the higher the directivity, the more efficient, or better, is the signal. In FIG. 31, a plot of the directivity or signal strength 340 of a cruciform-shaped high-band radiator 144*a*, 146*a*, 144*b*, 146*b* reveals that @ 1910 Mhz, the signal strength is about 18.50 dBi. It will be apparent that the strength of the signal directivity at this frequency of 1910 MHz drops precipitously at this point of resonance (approximately 2× the low-band frequency of 800 Mhz.) It will also be apparent that the signal strength recovers to about 19.50 dBi, and yet further to about 20.00 dBi, @ 1950 Mhz when employing segmented, electrically-connected radiator elements 312, 314, 316, 318, 320, 322, 324, 326, 328.

In summary, the first and second unit cells 110, 120 are configured to improve the efficacy of the signal, the amount and type of signal interference imposed by the low and high-band radiators 130, 132, 140, 142 and the signal to noise ratio developed by the low and high-band radiators 130, 132, 140, 142. That is, by changing the configuration of the low and high-band radiators 130, 132, 140, 142, the resonant response thereof can be mitigated along with amplification or cancellation of the RF energy transmitted by the radiators 130, 132, 140, 142. In one embodiment, the coupling elements 313, 315, 317, 319, 323, 325, 327 of one of the unit cell radiators 130, 132, e.g., the low-band radiator elements, have a length dimension which is less than about λ/2, in another embodiment, the length dimension is less than about λ/4, and in yet another embodiment, the length dimension is less than about is less than about λ/7, wherein the wavelength A corresponds to the transmission frequency of other of the unit cell radiators 140, 142. In yet other embodiments, it may be desirable to suppress a resonant response associated with lower order harmonics. Consequently, the length dimension of the gap G may be smaller, and the length dimension of the radiator elements 312, 314, 316, 318, 320, 322, 324, 326, 328 may be within a range between about λ/9-λ/16. As such, the resonant response is obviated with respect to other lower order harmonics of the same radiator element 312, 314, 316, 318, 320, 322, 324, 326, 328.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A telecommunications antenna, comprising:

a plurality of unit cells each including a pair of radiators transmitting RF energy within a range of bandwidth, at least one of the radiators transmits RF energy within a range of bandwidth which is a multiple of another radiator such that a resonant condition may be induced into the at least one radiator upon activation of the other radiator; and wherein at least one of the radiators is segmented such that select wavelengths are filtered to avoid unwanted resonances in the at least one radiator upon activation of the other radiator, wherein at least one radiator includes a low-band dipole element having a dipole stem including a plurality of low-band radiator elements, each of the plurality of low-band radiator elements has a length dimension smaller than $\lambda/7$, wherein at least one radiator includes a high-band dipole comprising a plurality of high-band radiator elements, each of the plurality of high-band radiator elements has a length dimension smaller than $\lambda/4$, wherein $\lambda$ is a wavelength of the RF energy transmitted by the high-band radiator elements.

2. The telecommunications antenna of claim 1, wherein each of the low-band radiator elements is separated by a dielectric gap and further comprises at least one coupling element disposed across the dielectric gap to capacitively couple the plurality of low-band radiator elements.

3. The telecommunications antenna of claim 2, wherein the low-band dipole element includes an L-shaped dipole element in an azimuth plane, wherein each L-shaped dipole element has first dipole stem oriented axially along an elongate axis of the antenna and a second dipole stem oriented orthogonally relative to the first dipole stem.

4. The telecommunications antenna of claim 3, wherein the a high-band radiator comprises a pair of cruciform-shaped radiators disposed in an azimuth plane, wherein each of the plurality of high-band radiator elements is separated by a dielectric gap, and wherein at least one coupling element is disposed across the dielectric gap to capacitively couple the plurality of high-band radiator elements.

5. The telecommunications antenna of claim 1, wherein wherein the at least one radiator is segmented into capacitively-connected radiator elements to suppress a resonance response in the at least one radiator upon activation of the other radiator.

6. The telecommunications antenna of claim 1, wherein each of the radiator elements has a length dimension corresponding to bandwidths within a range of between about $\lambda/9$-$\lambda/16$, wherein $\lambda$ is the wavelength of the RF energy transmitted by the other radiator.

7. A telecommunications antenna, comprising:

a plurality of unit cells each including a pair of radiators transmitting RF energy within a range of bandwidth, at least one of the radiators transmitting within a range of bandwidth which is a multiple of another radiator such that a resonant condition may be induced into the at least one radiator upon activation of the other radiator;

wherein the at least one radiator being segmented into capacitively-connected radiator elements to suppress a resonance response in the at least one radiator upon activation of the other radiator, wherein the at least one radiator includes a low-band dipole element having a dipole stem including a plurality of low-band radiator elements, each of the plurality of low-band radiator elements has a length dimension smaller than $\lambda/7$, wherein at least one radiator includes a high-band dipole comprising a plurality of high-band radiator elements, each of the plurality of high-band radiator elements has a length dimension smaller than $\lambda/4$, and wherein $\lambda$ is a wavelength of the RF energy transmitted by the high-band radiator elements.

8. The telecommunications antenna of claim 7, wherein each of the low-band radiator elements is separated by a dielectric gap and at least one coupling element disposed across the dielectric gap to capacitively couple the plurality of low-band radiator elements.

9. The telecommunications antenna of claim 8, wherein the low-band dipole element includes an L-shaped dipole element in an azimuth plane, wherein each L-shaped dipole element has first dipole stem oriented axially along an elongate axis of the antenna and a second dipole stem oriented orthogonally relative to the first dipole stem.

10. The telecommunications antenna of claim 8, wherein the high-band radiator comprises a pair of cruciform-shaped radiators disposed in an azimuth plane, and wherein the plurality of high-band radiator elements are separated by a dielectric gap and further comprising at least one coupling element disposed across the dielectric gap to capacitively couple the plurality of high-band radiator elements.

11. The telecommunications antenna of claim 8, wherein each of the radiator elements has a length dimension corresponding to bandwidths within a range of between about $\lambda/9$-$\lambda/16$, wherein $\lambda$ is a wavelength of the RF energy transmitted by the other radiator.

* * * * *